US007518573B2

(12) United States Patent
Sasaki et al.

(10) Patent No.: US 7,518,573 B2
(45) Date of Patent: Apr. 14, 2009

(54) DRIVING METHOD OF PLASMA DISPLAY PANEL AND PLASMA DISPLAY DEVICE

(75) Inventors: Takashi Sasaki, Hiratsuka (JP); Takayuki Kobayashi, Machida (JP); Naoki Itokawa, Kawasaki (JP)

(73) Assignee: Fujitsu Hitachi Plasma Display Limited, Kanagawa (JP)

( * ) Notice: Subject to any disclaimer, the term of this patent is extended or adjusted under 35 U.S.C. 154(b) by 635 days.

(21) Appl. No.: 11/327,422

(22) Filed: Jan. 9, 2006

(65) Prior Publication Data

US 2006/0164343 A1 Jul. 27, 2006

(30) Foreign Application Priority Data

Jan. 11, 2005 (JP) ..... 2005-003661

(51) Int. Cl.
*G09G 3/28* (2006.01)

(52) U.S. Cl. ..... 345/60; 345/67; 345/68

(58) Field of Classification Search ..... 345/41, 345/60–68; 315/169.3–169.4
See application file for complete search history.

(56) References Cited

U.S. PATENT DOCUMENTS 6,489,727 B2 * 12/2002 Kanazawa ..... 315/169.4
2004/0108975 A1 * 6/2004 Araki ..... 345/63

FOREIGN PATENT DOCUMENTS

| | | |
|---|---|---|
| JP | 2000-123741 | 4/2000 |
| JP | 2001-034228 | 2/2001 |
| JP | 2003-337566 | 11/2003 |
| JP | 2004-192875 | 7/2004 |

* cited by examiner

*Primary Examiner*—Richard Hjerpe
*Assistant Examiner*—Mansour M Said
(74) *Attorney, Agent, or Firm*—Antonelli, Terry, Stout & Kraus, LLP.

(57) ABSTRACT

In a plasma display device comprising: plural first, second, and third electrodes disposed adjacently and extending in a first direction, the third electrodes being provided between the first and second electrodes for repeating discharges; a dielectric layer covering the electrodes, a first electrode driving circuit for driving the first electrodes; a second electrode driving circuit for driving the second electrodes; and a third electrode driving circuit for driving the third electrodes, gray-scale display is performed by a sub-field method, and the third electrodes are set to have a potential approximately the same as that of the first or second electrode at the discharge in the repetitive discharges. The third electrode driving circuit changes the ratio of the discharges in which the third electrodes operate as cathodes to the discharges in which they operate as anodes in the period when the discharges are repeated, at least in one sub-field.

14 Claims, 16 Drawing Sheets

(VERTICAL DIRECTION)

(LATERAL DIRECTION)

DRIVING METHOD OF PLASMA DISPLAY PANEL AND PLASMA DISPLAY DEVICE

CROSS-REFERENCE TO RELATED APPLICATION

The present application claims priority from Japanese Patent Application No. JP 2005-3661 filed on Jan. 11, 2005, the content of which is hereby incorporated by reference into this application.

TECHNICAL FIELD OF THE INVENTION

The present invention relates to an A/C plasma display panel (PDP) used for a display device of a personal computer and a workstation, a flat TV, and a plasma display for displaying advertisements, information, and others.

BACKGROUND OF THE INVENTION

In AC color PDP devices, an address/display separation (ADS) method in which a period when the cells to be displayed are determined (address period) and a display period when discharges for display lighting are performed (sustain period) are separated is widely employed. In this method, charge is accumulated in the cells, which are to be turned on, in the address period, and discharges for display are performed by utilizing the charge in the sustain period.

Also, plasma display panels include: a two-electrode type PDP in which a plurality of first electrodes extending in a first direction are provided in parallel to each other and a plurality of second electrodes extending in a second direction which is perpendicular to the first direction are provided in parallel to each other; and a three-electrode type PDP in which a plurality of first electrodes and second electrodes extending in a first direction are alternately provided in parallel to each other and a plurality of address electrodes extending in a second direction perpendicular to the first direction are provided in parallel to each other. In recent years, the three-electrode type PDPs have been widely used.

In a general structure of the three-electrode type PDPs, first (X) electrodes and second (Y) electrodes are alternately provided in parallel to each other on a first substrate, address electrodes extending in a direction which is perpendicular to the extending direction of the first and second electrodes are provided on a second substrate opposite to the first substrate, and the surfaces of the electrodes are covered by dielectric layers. On the second substrate, barrier ribs which are extending in one direction and arranged in stripes between the address electrodes in parallel to the address electrodes or barrier ribs which are arranged in lattice pattern and disposed in parallel to the address electrodes and the first and second electrodes so as to individually separate the cells are further provided, and the first and the second substrates are attached to each other after phosphor layers are formed between the barrier ribs. Therefore, the dielectric layers and the phosphor layers and further the barrier ribs are formed on the address electrodes.

Discharges are caused in all of the cells by applying voltage between the first and second electrodes to make the charge (wall charge) in the vicinity of the electrodes uniform. Then, the addressing for selectively leaving the wall charge in the cells to be turned on is performed by sequentially applying scan pulses to the second electrodes and applying address pulses to the address electrodes in synchronization with the scan pulses. Subsequently, sustain discharge (sustain) pulses of potentials of alternately changed polarities are applied between the two adjacent first and second electrodes where discharges are to be performed. By doing so, the sustain discharges are performed in the cells to be turned on in which the wall charge has been formed through the addressing, thereby performing the lighting. The phosphor layers emit light by ultraviolet rays generated through the discharges, and the light is seen through the first substrate. Therefore, the first and second electrodes are comprised of non-transparent bus electrodes formed of metal materials and transparent electrodes such as ITO films, and the light generated in the phosphor layers can be seen through the transparent electrodes. Since structures and operations of general PDPs are widely known, detailed descriptions thereof will be omitted here.

In the field of the above-described three-electrode type PDP, various types of PDPs in which third electrodes are respectively provided between the first electrodes and the second electrodes in parallel thereto have been proposed.

For example, Japanese Patent Application Laid-Open Publication No. 2000-123741 (Patent Document 1) discloses a PDP device which performs interlaced display by utilizing display lines between first electrodes and third electrodes and between second electrodes and third electrodes.

Furthermore, Japanese Patent Application Laid-Open Publication No. 2001-34228 (Patent Document 2) and No. 2004-192875 (Patent Document 3) disclose the structure in which third electrodes are provided between first electrodes and second electrodes where discharge is not performed (non-display line) so that the third electrodes are utilized for trigger operations, prevention of discharges in non-display lines (prevention of reverse slit), reset operations, and others.

In general, the three-electrode type PDPs merely control lighting and non-lighting, and it is difficult to carry out grayscale display by precisely changing the light emission intensity. Therefore, in PDP devices, one display field is comprised of a plurality of sub-fields in general, and the grayscale display is carried out by combining the lighting sub-fields. The grayscales which can be displayed in this case correspond to combinations of luminance of the sub-fields. For example, if 8 sub-fields in which a luminance ratio is sequentially changed in the powers of 2 are provided, display of 256 grayscales can be carried out. Although this sub-field structure is the most efficient structure in terms of the relation between the number of sub-fields and the number of grayscales which can be displayed, it has a problem of, for example, the color drift and edge distortion. Therefore, various sub-field structures for reducing the color drift and edge distortion have been proposed.

Meanwhile, Japanese Patent Application Laid-Open Publication No. 2003-337566 (Patent Document 4) discloses a structure in which second (Y) electrodes are sorted into primary second electrodes and auxiliary second electrodes which are selectively used, and by selecting the second electrode to be used, the discharge area can be changed in each display line so as to change the luminance. When this structure is applied to the sub-field structure, the number of grayscales which can be displayed is increased.

Meanwhile, in PDP devices, it is desired to improve luminance (light emission amount) so as to obtain high display luminance. Therefore, in general, the total number of sustain pulses in sub-fields of one field, i.e., the number of total sustain pulses in one field is set as the maximum value. However, when the bright display is carried out on the entire screen, the amount of currents (electric power) fed to the entire panel increases, and the panel temperature increases to exceed a permissible value. Therefore, in such a case, power control for reducing the number of total sustain pulses in one field is performed. When the number of total sustain pulses is reduced, the numbers of sustain pulses are allotted to each of the sub-fields in accordance with the luminance ratio. However, the minimum number of total sustain pulses for accurately allotting the numbers of sustain pulses to the sub-fields in accordance with the luminance ratio is fixed, and if the number of total sustain pulses at that point is not an integral multiple of the minimum number of total sustain pulses, the numbers of sustain pulses cannot be accurately allotted to the sub-fields in accordance with the luminance ratio, and some errors occur in the luminance ratio.

Note that the number of total sustain pulses in one field is changed not only for the above-described power control but also for the prevention of local temperature increase in a still image and the like.

SUMMARY OF THE INVENTION

In the structure disclosed in Patent Document 4, only one of the primary second electrode and the auxiliary second electrode is utilized. Therefore, there is a problem that light emission efficiency is lower than the case where second electrodes having an area corresponding to that of the combination of the primary second electrodes and the auxiliary second electrodes are used. Moreover, in the structure disclosed in Patent Document 4, the grayscale display can be changed for each display line, and there is a problem when actually increasing the grayscale display in each display cell.

In addition, when the number of total sustain pulses in one field is changed as described above, the numbers of sustain pulses cannot be accurately allotted to the sub-fields in accordance with the luminance ratio, and errors occur in the luminance ratio. The influence of the errors is particularly large in low grayscale parts, and there is a problem that desired grayscale display cannot be performed in the low grayscale parts where the errors in grayscale display are significant.

The present invention is to realize a novel luminance adjustment method of a plasma display panel. In particular, an object of the present invention is to realize a driving method of a plasma display panel and a plasma display device which make it possible to perform accurate grayscale display by reducing errors in the luminance ratio of sub-fields, even when the number of total sustain pulses in one field is changed.

In order to realize the above-described object, in a driving method of a plasma display panel (PDP) of the present invention, in a three-electrode type PDP, third electrodes are provided between first (X) electrodes and second (Y) electrodes between which discharges are to be repeated, and a ratio of discharges in which the third electrodes operate as cathodes to the discharges in which the third electrodes operate as anodes during a period when discharges are repeated between the first and second electrodes is changed at least in one sub-field. Consequently, the luminance of the sub-field can be changed. Accordingly, even when the number of total sustain pulses in one field is changed, the luminance ratio of the sub-fields can be set close to a predetermined ratio, and accurate grayscale display can be carried out.

More specifically, in a driving method of a plasma display panel according to the present invention, the plasma display panel comprises: a plurality of first, second, and third electrodes which are disposed to be adjacent to each other and extending in a first direction, the third electrodes being provided respectively between the first and second electrodes between which discharges are to be repeated; and a dielectric layer which covers the plurality of first, second, and third electrodes, grayscale display is carried out by means of a sub-field method, and the third electrodes are set to have a potential which is approximately the same as the potential of one of the first and second electrodes at least at the time of the discharges during a period when the discharges are repeated between the first and second electrodes. In this driving method of a plasma display panel, a ratio of the discharges in which the third electrodes operate as cathodes to the discharges in which the third electrodes operate as anodes in the period when the discharges are repeated between the first and second electrodes is changed at least in one sub-field.

In a conventional PDP, first and second electrodes have been comprised of first and second bus electrodes extending in parallel to each other and transparent first and second discharge electrodes which are provided so as to be connected to the first and second bus electrodes in each cell. In sustain discharges in this structure, sustain pulses having alternately changed polarities are repeatedly applied to the first and second electrodes so as to generate sustain discharges. In other words, the first electrode becomes an anode and a cathode alternately, and similarly, the second electrode also becomes a cathode and an anode alternately. Therefore, in conventional PDPs, in consideration of the symmetric property of discharges, the first discharge electrode and the second discharge electrode have the same shape. Also in the structure disclosed in Patent Document 4, the discharge area changes depending on which one is selected from the primary second electrode and the auxiliary second electrode and the luminance also changes, and the selected primary electrode or the auxiliary second electrode becomes a cathode and an anode alternately.

The inventors of the present invention have carried out an experiment about the relation between the area ratio of the anode to the cathode and the amount of emitted light in a discharge, and found out that the amount of emitted light is large when the area of the cathode is larger than the area of the anode. Specifically, when the case where the area ratio of the discharge area of the cathode to the discharge area of the anode is 3:1 is compared with the case where the ratio is 1:3, visible light of about 1.5 times that of the other case is outputted in the case where the cathode area is larger. Therefore, it is conceived that, in a discharge, the light emission amount of a cathode is about twice that of an anode.

Therefore, during a sustain discharge period, if the third electrode is operated as a cathode, the luminance is increased, and if the third electrode is operated as an anode, the luminance is reduced. For example, in the case where a discharge is to be performed while the first (X) electrode is operated as a cathode and the second (Y) electrode is operated as an anode, when the discharge is performed while the third (Z) electrode is also operated as a cathode, a discharge with a large light emission amount is performed with using a large area of the combination of the first electrode and the third electrode as a cathode. On the other hand, when a discharge is performed while the third electrode is operated as an anode, the cathode is only the first electrode, and the anode is the wide area of the combination of the second electrode and the third electrode. Therefore, the light emission amount is reduced. This principle is true of the case where a discharge is performed with using the first (X) electrode as an anode and the second (Y) electrode as a cathode.

In the present invention, the luminance is changed by changing the ratio of the discharges in which the third (Z) electrode operates as a cathode to the discharges in which the third electrode operates as an anode in the sustain discharge period of each sub-field in which discharges are repeated. As described above, in the sustain discharge period, the luminance is the highest when the third electrode operates as a cathode all the time, and inversely, the luminance is the lowest when the third electrode operates as an anode all the time.

Also, the luminance is intermediate when the third electrode operates as a cathode at the beginning of the sustain discharge period and then is switched to operate as an anode. Various intermediate luminance levels are obtained by changing the switching timing, i.e., by changing the ratio of the periods in which the third electrode operates as an anode to the periods in which the third electrode operates as a cathode. If the third electrode operates as a cathode all the time, the display luminance is improved in comparison with the case where the third electrode alternately operates as a cathode and an anode.

For the simplification of the structure of a driving circuit of the third electrodes, it is desired to drive the third electrodes in common. In such a case, a driving voltage similar to the driving voltage applied to the first (X) electrodes is applied thereto in an address period. In a conventional structure, since the first electrode operates as a cathode at the beginning of the sustain discharge period, the third electrode also operates as a cathode at the beginning of the sustain discharge period. Therefore, during the sustain discharge period, the third electrode cannot operate as an anode all the time, and the third electrode is switched to be operated as an anode at the middle of the period. In this case, the luminance in the case where the third electrode operates as a cathode all the time is the highest, and the luminance in the case where the third electrode operates as a cathode once and operates as an anode in the rest period is the lowest. Also, the luminance can be adjusted between them in accordance with the number of levels corresponding to the number of discharges in which the third electrode operates as an anode.

As described above, the case where the number of total sustain pulses of one field has to be changed but the sustain pulses cannot be allotted to sub-fields in accordance with a predetermined luminance ratio will be described. For example, the luminance ratio of the sub-fields SF1 to SF4 is 1:2:4:8 and the number of sustain pulses which can be allotted to SF4 at a certain point is 29. In this case, according to the luminance ratio, the numbers of sustain pulses of SF1 to SF4 are 3.6:7.5:14.5:29, and the numbers of sustain pulses of SF1 to SF4 are set to 4:8:15:29 by rounding them up to the nearest integers. Therefore, the luminance ratio of SF1 to SF4 is deviated from the predetermined luminance ratio.

In the present invention, in SF4, the third electrode is operated as a cathode during the sustain discharge period, and in SF1 to SF3, the third electrode is operated as a cathode at the beginning of the sustain discharge period and the electrode is operated as an anode from the middle of the period in the manner as described above. By doing so, the luminance is reduced by 10%, 6%, 3% in SF1 to SF3 so that the luminance ratio of SF1 to SF4 becomes the predetermined luminance ratio.

As described above, during the sustain discharge period, the luminance is the highest when the third electrode operates as a cathode. Therefore, when the number of sustain pulses in one field is at the upper limit value, the third electrode is desired to operate only as a cathode at the time of the discharges in the period when the discharges are repeated. Consequently, the highest display luminance can be increased.

In order to operate the third electrode as a cathode all the time during the sustain discharge period, the voltage applied to the third electrode has to be changed at the half cycle of the cycle for changing the voltage applied to the first and second electrodes (sustain cycle). More specifically, a voltage that is changed at a frequency twice the sustain frequency has to be applied to the third electrode.

For example, when the third electrode is switched to an anode after a discharge is performed with using the first electrode and the third electrode as cathodes and the second electrode as an anode, negative wall charge is accumulated in the vicinity of the third electrode (on the dielectric layer). At this point, positive wall charge is accumulated in the vicinity of the first electrode, and negative wall charge is accumulated in the vicinity of the second electrode. When a sustain pulse of changed polarity is to be subsequently applied between the first electrode and the second electrode, the third electrode is switched to a cathode again. Thereafter, by repeating the above-described operations, discharges of a large light emission amount in which the third electrode is operated as a cathode all the time can be carried out.

When the third electrode is switched so as to operate as an anode during the sustain discharge period, the third electrode is maintained as a cathode even after a discharge is performed without changing the third electrode to an anode. By doing so, positive wall charge is accumulated in the vicinity of the third electrode. Then, when the sustain pulse of a changed polarity is applied between the first electrode and the second electrode, the third electrode is switched to be an anode. More specifically, the polarity of the potential which is applied to the third electrode at this point is changed at the same cycles as the sustain pulse. When a discharge is generated by this sustain pulse, the third electrode is changed to a cathode, and positive wall charge is accumulated in the vicinity of the third electrode. Thereafter, by changing the voltage applied to the third electrode at a frequency that is twice the frequency of the sustain pulse, the third electrode continues discharge operations as an anode.

Generation of a discharge is delayed from the application of the voltage, the discharge intensity attains a peak value after a certain time, and then, the discharge intensity gradually attenuates to complete the discharge. Ultraviolet rays are generated by the discharge, the ultraviolet rays excite the phosphor to generate visible light, and the light is outputted to outside the panel through the glass substrate. The ultraviolet rays are not outputted to outside since they are absorbed by the glass substrate, and the ultraviolet rays cannot be detected outside the panel. Infrared light is also generated together with the ultraviolet rays by the discharge, and the generation timing of the ultraviolet rays and the infrared light is approximately the same. Therefore, the state variation of the discharge can be detected by measuring the infrared light.

The timing for switching the state of the third (Z) electrode from a cathode to an anode so as to accumulate the charge is desired to be after the discharge is completely finished. In other words, it is preferred that the third (Z) electrode is not switched to an anode during the period when the outputted infrared light is strong. In this case, for example, the third (Z) electrode is switched to an anode at the point when the outputted infrared light is reduced to the intensity that is 10% of the peak intensity.

The present invention can be applied to a driving method of a normal plasma display panel (PDP) in which first and second electrodes form pairs and sustain discharges are performed between the paired first and second electrodes and to a driving method of an ALIS PDP disclosed in Japanese Patent No. 2801893 (Patent Document 5) in which sustain discharges are performed between all of a plurality of first and second electrodes.

According to the present invention, a driving method of a plasma display panel and a plasma display device which can obtain high display luminance by increasing the light emission amount and can adjust luminance of sub-fields can be realized. As a result, even when the number of total sustain pulses of one field is changed, the luminance ratio of the sub-fields can be adjusted to be a predetermined ratio, and accurate grayscale display can be carried out.

BRIEF DESCRIPTIONS OF THE DRAWINGS

DESCRIPTIONS OF THE PREFERRED EMBODIMENTS

Figure 1:
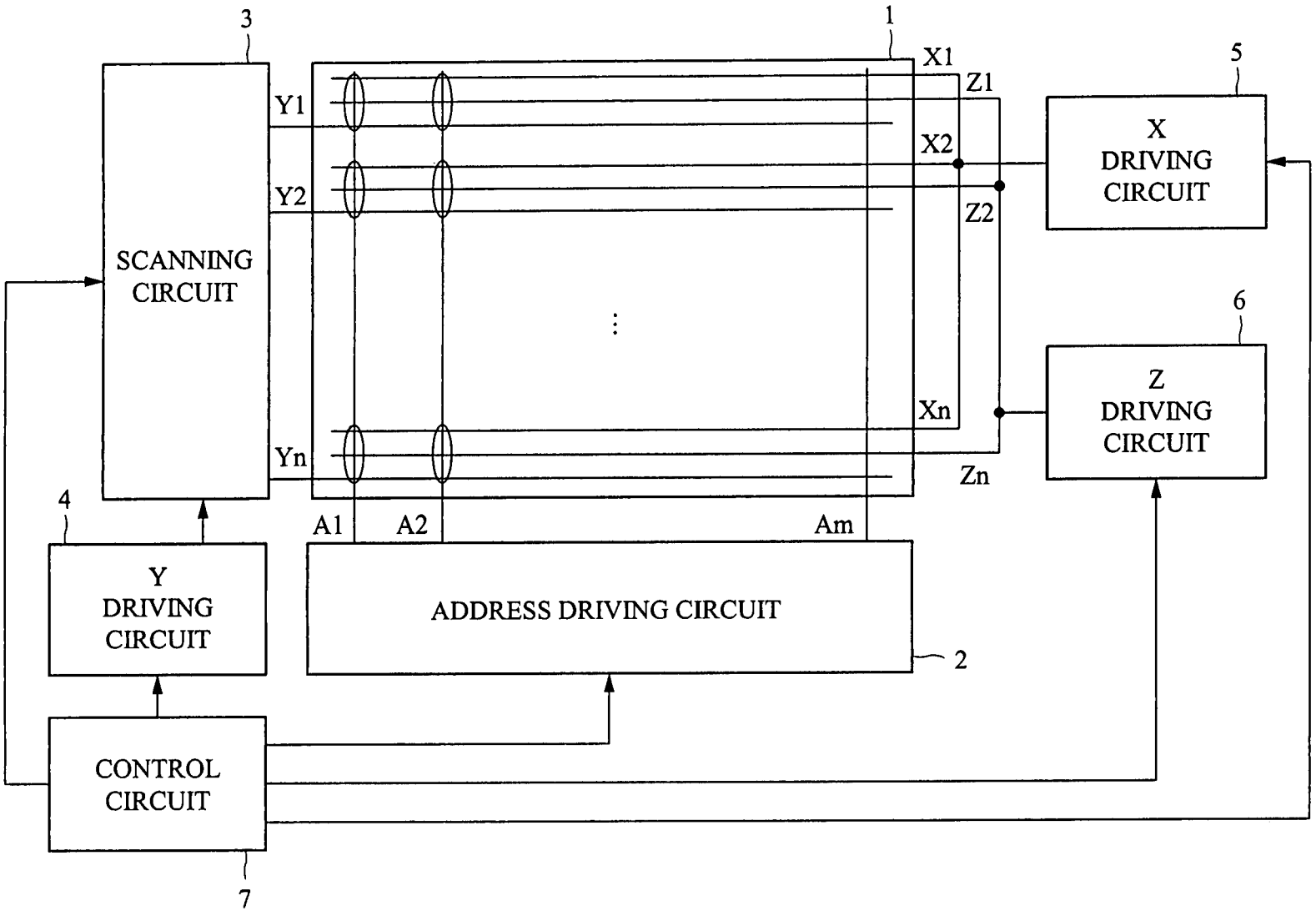
FIG. 1 is a diagram showing the entire structure of a PDP device of a first embodiment of the present invention.

FIG. 1 is a diagram showing the entire structure of a plasma display device (PDP device) of a first embodiment of the present invention. A PDP 1 used in the PDP device of the first embodiment is obtained by applying the present invention to a conventional PDP in which a discharge is performed between a pair of a first (X) electrode and a second (Y) electrode. As shown in FIG. 1, in the PDP 1 of the first embodiment, laterally extending X electrodes X1, X2, . . . , Xn and Y electrodes Y1, Y2, . . . , Yn are alternately disposed, and each of third electrodes Z1, Z2, . . . , Zn is disposed between the X electrode and the Y electrode of each pair. Therefore, n sets of three electrodes, that is, the X electrode, the Y electrode, and the Z electrode are formed. In addition, vertically extending address electrodes A1, A2, . . . , Am are disposed so as to intersect with the n sets of the X electrodes, the Y electrodes, and the Z electrodes, and cells are formed at the intersecting parts. Therefore, n display rows and m display columns are formed.

As shown in FIG. 1, the PDP device of the first embodiment has an address driving circuit 2 which drives the m lines of address electrodes, a scanning circuit 3 which applies scan pulses to the n lines of Y electrodes, a Y driving circuit 4 which applies voltages other than the scanning pulses to the n lines of Y electrodes in common via the scanning circuit 3, an X driving circuit 5 which applies voltages to the n lines of X electrodes in common, a Z driving circuit 6 which applies voltages to the n lines of Z electrodes in common, and a control circuit 7 which controls each of the circuits. The PDP device of the first embodiment is different from the conventional examples in that the Z electrodes are provided in the PDP 1, and the Z driving circuit 6 which drives them is provided, and other parts are the same as the conventional examples. Therefore, only the parts relating to the Z electrodes will be described here, and descriptions of other parts will be omitted.

Figure 2:
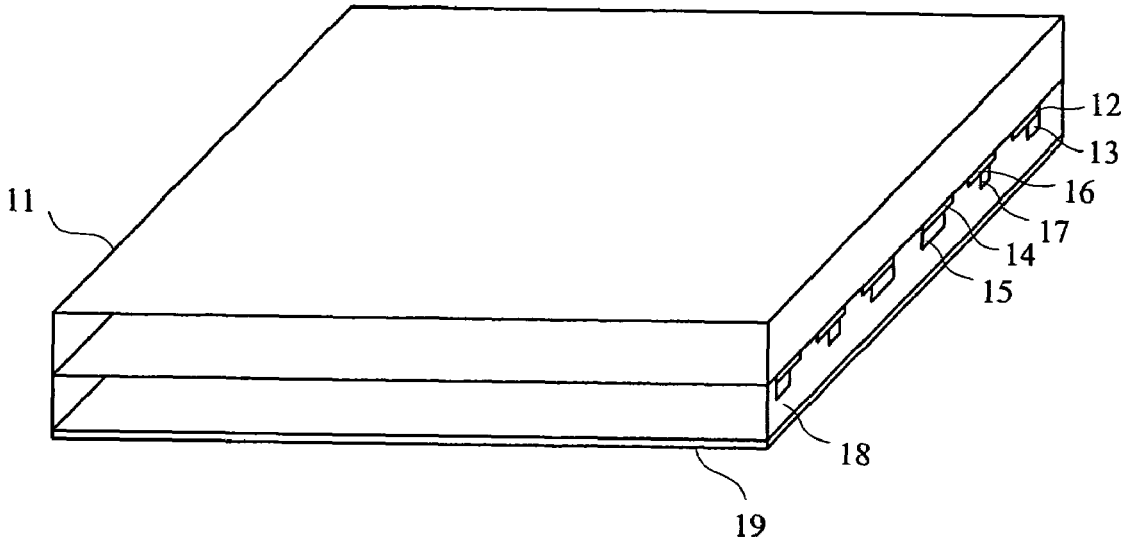
FIG. 2 is an exploded perspective view of the PDP of the first embodiment.
Figure 2:
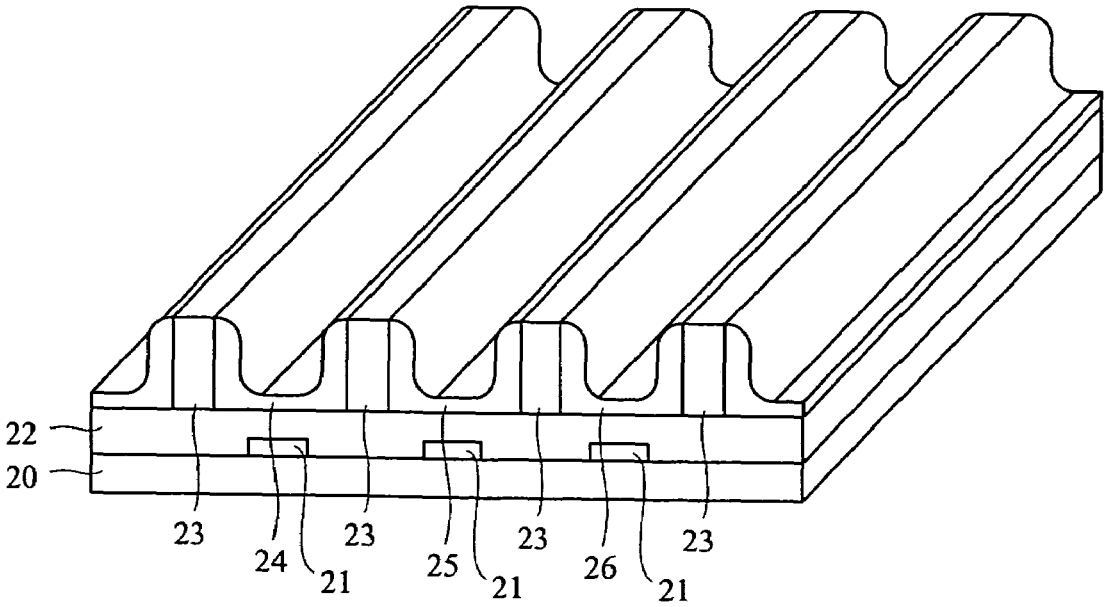

FIG. 2 is an exploded perspective view of the PDP of the first embodiment. As shown in FIG. 2, on a front (first) glass substrate 11, laterally extending first (X) bus electrodes 13 and second (Y) bus electrodes 15 are alternately disposed in parallel to each other so as to form pairs. X and Y optically transparent electrodes (discharge electrodes) 12 and 14 are provided so as to be overlapped over the X and Y bus electrodes 13 and 15, and parts of the X and Y discharge electrodes 12 and 14 are extending toward the side of the opposing electrodes. A third discharge electrode 16 and a third bus electrode 17 overlapped with each other are provided between the X and Y bus electrodes 13 and 15 of each pair. For example, the bus electrodes 13, 15, and 17 are formed of metal layers and the discharge electrodes 12, 14, and 16 are formed of ITO films or the like, and the resistance values of the bus electrodes 13, 15, and 17 are lower than or equal to the resistance values of the discharge electrodes 12, 14, and 16. Hereinafter, the parts of the X and Y discharge electrodes 12 and 14 extending from the X and Y bus electrodes 13 and 15 will be simply referred to as X and Y discharge electrodes 12 and 14, respectively, and the third discharge electrode 16 and the third bus electrode 17 will be together referred to as a third electrode.

On the discharge electrodes 12, 14, and 16 and the bus electrodes 13, 15, and 17, a dielectric layer 18 is formed so as to cover the electrodes. The dielectric layer 18 is made of $SiO_2$ or the like through which visible light can pass and it is formed by the vapor deposition method, and a protective layer 19 of MgO or the like is further formed on the dielectric layer 18. The protective layer 19 has effects of reducing discharge voltages, reducing discharge delay, and others by emitting electrons through ion bombardment to accelerate discharges. Since all of the electrodes are covered with the protective layer 19 in this structure, discharges utilizing the effects of the protective layer can be performed regardless which electrode group becomes a cathode. The glass substrate 11 having the above-described structure is utilized as a front substrate, and display is seen through the glass substrate 11.

Meanwhile, address electrodes 21 are provided on a rear (second) substrate 20 so as to intersect with the bus electrodes 13, 15, and 17. For example, the address electrodes 21 are formed of metal layers. On the group of the address electrodes, a dielectric layer 22 is formed, and vertical barrier ribs 23 are formed on the dielectric layer 22. In addition, phosphor layers 24, 25, and 26 which emit visible light of red, green, and blue when excited by the ultraviolet rays generated upon discharges are coated on the side surfaces and bottom surfaces of the grooves formed by the barrier ribs 23 and the dielectric layer 22.

Figure 3A:
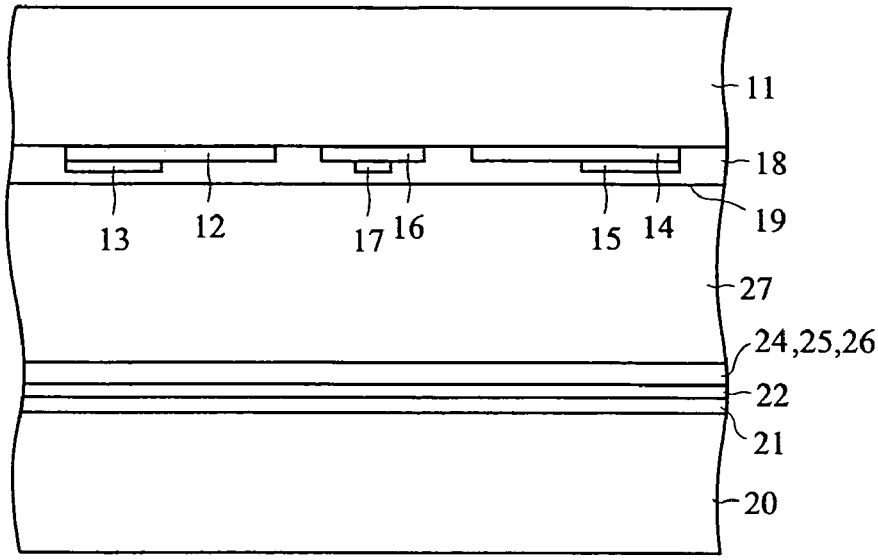
FIG. 3A is a cross-sectional view of the PDP of the first embodiment.
Figure 3B:
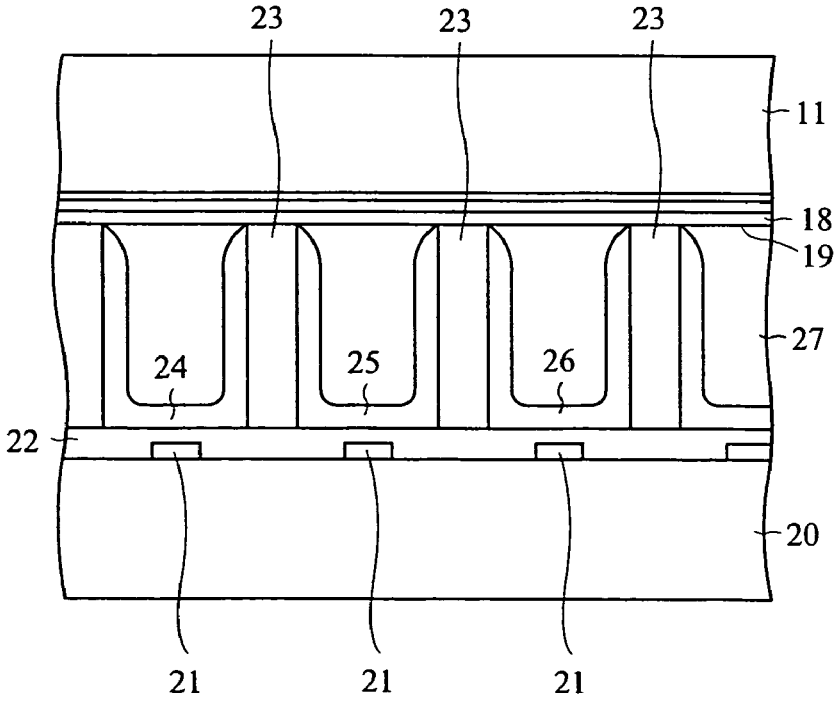
FIG. 3B is a cross-sectional view of the PDP of the first embodiment.

FIG. 3A and FIG. 3B are partial cross-sectional views of the PDP 1 of the first embodiment, wherein FIG. 3A is a vertical cross-sectional view, and FIG. 3B is a lateral cross-sectional view. Discharge gases such as Ne, Xe, and He are sealed in discharge spaces 27 between the front substrate 11 and the rear substrate 20, which are divided by the barrier ribs 23.

Figure 4:
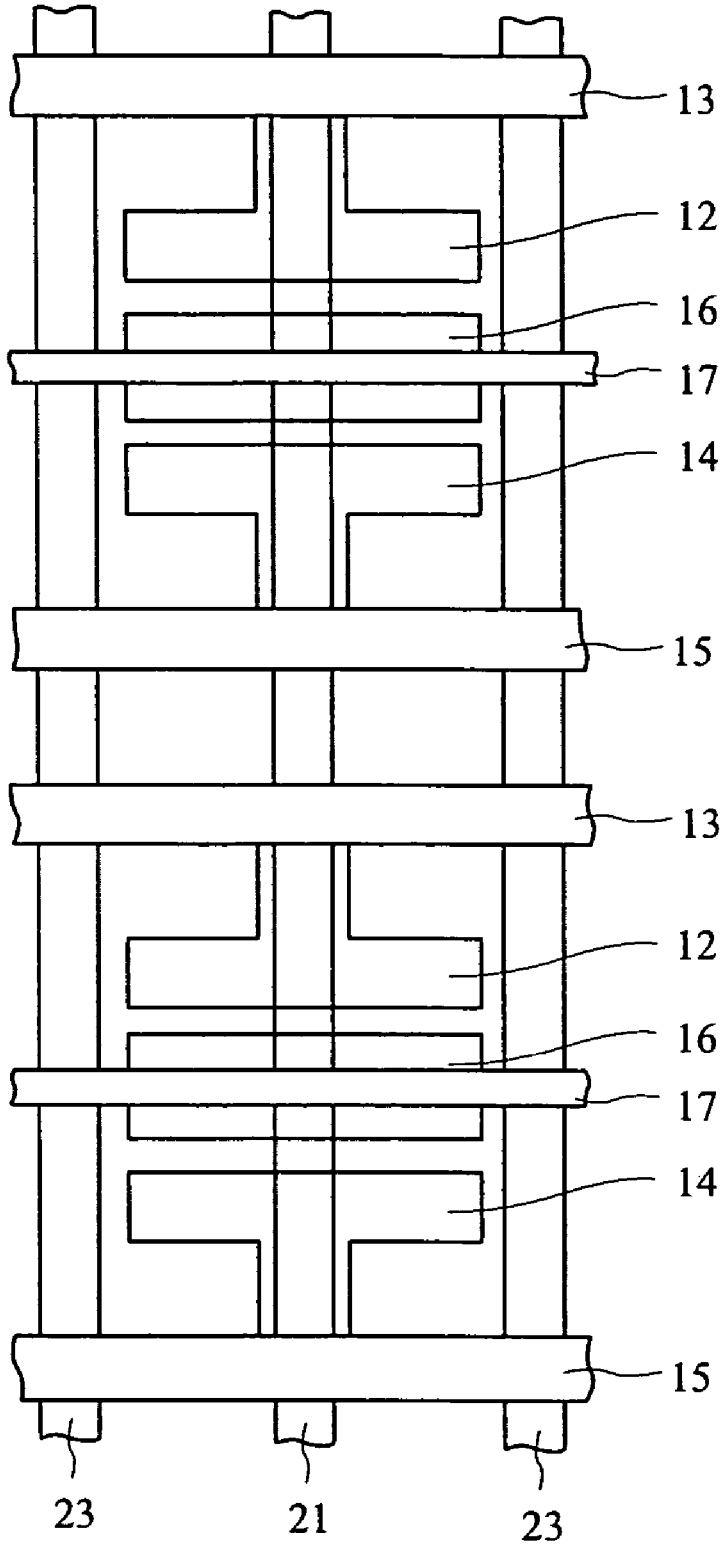
FIG. 4 is a diagram showing the shapes of the electrodes of the first embodiment.

FIG. 4 is a diagram showing the shapes of the electrodes of two upper and lower cells. As shown in the diagram, the X bus electrode 13 and the Y bus electrode 15 are disposed in parallel to each other, and the Z bus electrode 17 is disposed in parallel to them at the center between them. In addition, the barrier ribs 23 extending in the direction perpendicular to the bus electrodes 13, 15, and 17 are disposed. The address electrode 21 is disposed between the barrier ribs 23. In each section divided by the barrier ribs 23, the T-shaped X discharge electrodes 12 extending from the X bus electrodes 13, the T-shaped Y discharge electrodes 14 extending from the Y bus electrodes 15, and the Z discharge electrodes 16 extending toward both the upper and lower sides from the Z bus electrodes 17 are provided. The opposing edges of the X discharge electrodes 12 and the Z discharge electrodes 16 and the opposing edges of the Y discharge electrodes 14 and the Z discharge electrodes 16 are parallel to the extending direction of the bus electrodes 13, 15, and 17, and the distances therebetween are constant.

Figure 5A:
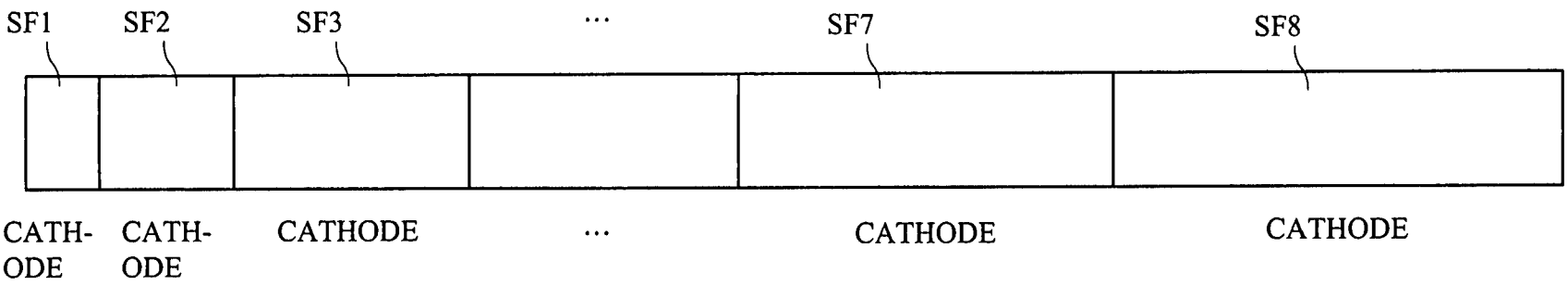
FIG. 5A is a diagram showing a sub-field structure of one field of the PDP device of the first embodiment.
Figure 5B:
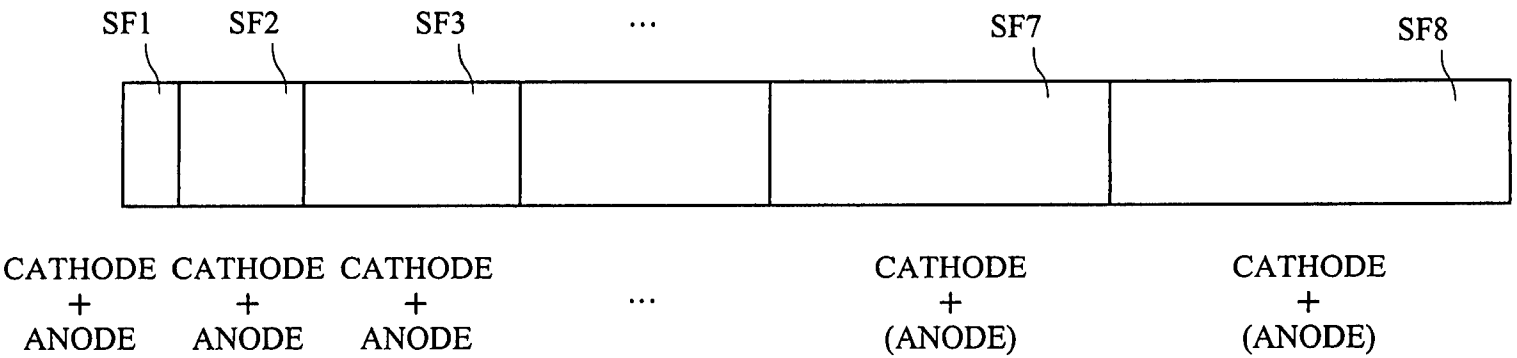
FIG. 5B is a diagram showing a sub-field structure of one field of the PDP device of the first embodiment.

Next, operations of the PDP device of the first embodiment will be described. In each cell of the PDP, only On/Off can be selected, and lighting luminance cannot be changed, i.e., grayscale display cannot be performed. Therefore, as shown in FIG. 5A and FIG. 5B, one frame is divided into a plurality of predetermined weighted sub-fields SF1 to SF8, and grayscale display is performed for each cell by combining the lighting sub-fields in one frame. The sub-fields normally have the same driving sequence except for the number of sustain discharges.

As described above, the number of the total sustain pulses of one field is controlled in order to prevent local overheating of the panel due to power control or a still image. The number of the total sustain pulses of one field is set to the upper limit value since bright display is normally desirable. In the sustain discharge periods of all of the sub-fields, the Z electrode is controlled to be operated as a cathode all the time. FIG. 5A shows this case, i.e., the case where the number of the total sustain pulses of one field is at the upper limit value, and the Z electrode operates as a cathode all the time in the sustain discharge periods of all of the sub-fields. Note that the upper limit value of the number of the total sustain pulses is assumed to be the number with which the numbers of the sustain pulses can be accurately allotted to the sub-fields in accordance with the luminance ratio. However, the present invention is not limited to this. Furthermore, the Z electrode is operated as a cathode all the time in the sustain discharge periods of all of the sub-fields when the number of the total sustain pulses of one field is at the upper limit value. However, the present invention is not limited to this, and the Z electrode may be operated partially as an anode in the sustain discharge periods of a predetermined sub-fields even when the number of the total sustain pulses is at the upper limit value.

When a bright display is to be performed on an entire panel or a still image with a locally bright part is to be displayed, the number of total sustain pulses of one field is reduced so as to prevent the overheating of the entire panel or a local part. FIG. 5B shows the case where the number of the total sustain pulses is reduced. In this case, the Z electrode is controlled to operate as an anode after operating as a cathode in the sustain discharge periods of at least a part of the sub-fields so that the luminance ratio of the sub-fields becomes the predetermined ratio. The luminance of the sub-fields can be finely adjusted by adjusting the ratio of the number of discharges in which the Z electrode operates as a cathode to the number of discharges in which the electrode operates as an anode in the sustain discharge period.

For example, when sustain discharges are generated four times in a sub-field, the maximum number of times that the third electrode operates as a cathode is four, and the maximum number of times that the third electrode operates as an anode is three, wherein the ratio of the number of times that it operates as an anode to the number of times that it operates as a cathode ranges from 0:4 to 3:1. In other words, the ratio of the number of times that it operates as an anode to the number of times of sustain discharges is varied from 0/4 to 3/4. If the areas of the discharge electrodes of the X electrode, the Y electrode, and the Z electrode are the same as shown in FIG. 4 and the light emission amount of a cathode is about twice as large as that of an anode, the luminance ratio of the case where the third electrode operates as a cathode to the case where the third electrode operates as an anode is 5:4. Therefore, the ratio of the luminance at the time when the third electrode operates as a cathode four times to the luminance at the time when the third electrode operates as an anode three times (one time as a cathode) is 20:17. In other words, when the luminance at the time when the third electrode operates as a cathode four times is defined as 1, the luminance can be reduced to about 85% at the time when the third electrode operates as an anode three times, and the luminance can be adjusted in three levels therebetween. The more the number of times of sustain discharges is in the sub-field, the wider the range of luminance adjustment becomes.

Note that, even when the number of the total sustain pulses is reduced, if the number of the total sustain pulses is an integral multiple of the minimum number of sustain pulses with which sustain pulses can be allotted to the sub-fields in accordance with the luminance ratio, the Z electrode is sometimes operated as a cathode in the sustain discharge periods of all of the sub-fields.

When the number of the total sustain pulses is reduced, the numbers of the sustain pulses are allotted to the sub-fields in accordance with the luminance ratio. However, the minimum number of the total sustain pulses with which the numbers of sustain pulses can be accurately allotted to the sub-fields in accordance with the luminance ratio is fixed, and when the number of total sustain pulses at that point is not an integral multiple of the minimum number of the total sustain pulses, the numbers of the sustain pulses cannot be accurately allotted to the sub-fields in accordance with the luminance ratio, and thus, errors are caused in the luminance ratio. For example, if the luminance ratio of SF1 to SF8 is 1:2:4: . . . : 128, the minimum number of the total sustain pulses is 255. If the upper limit value of the number of the total sustain pulses is 1020 pulses, 4, 8, . . . , 256, 512 pulses are allotted to SF1 to SF8.

When the number of the total sustain pulses is reduced to 800, for example, 3, 6, 13, 25, 50, 100, 201, and 402 pulses are allotted to SF1 to SF8. If SF3 is set to 12 pulses, the luminance ratio is increased in SF1 to SF6 and slightly decreased in SF7 to SF8 when compared with the predetermined luminance ratio. Minute differences in the luminance are not distinct when sub-fields of high luminance are combined. Therefore, the errors of the luminance ratio in SF7 to SF8 will be ignored, and the ratio of the Z electrode operating as an anode in the sustain discharge period is adjusted so that the ratio of SF1 to SF5 becomes the predetermined luminance ratio.

Figure 6:
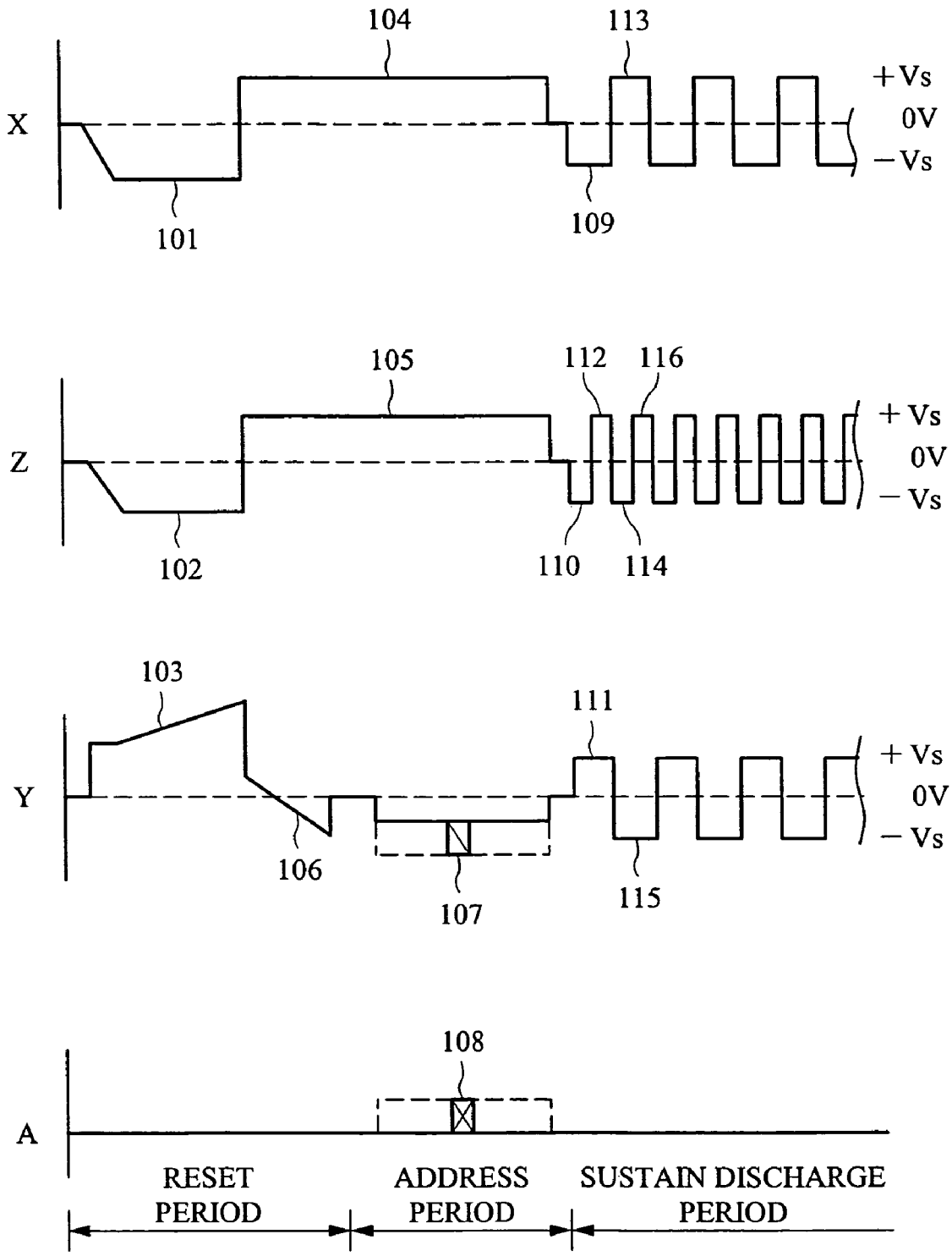
FIG. 6 is a diagram showing driving waveforms of the first embodiment.
Figure 7:
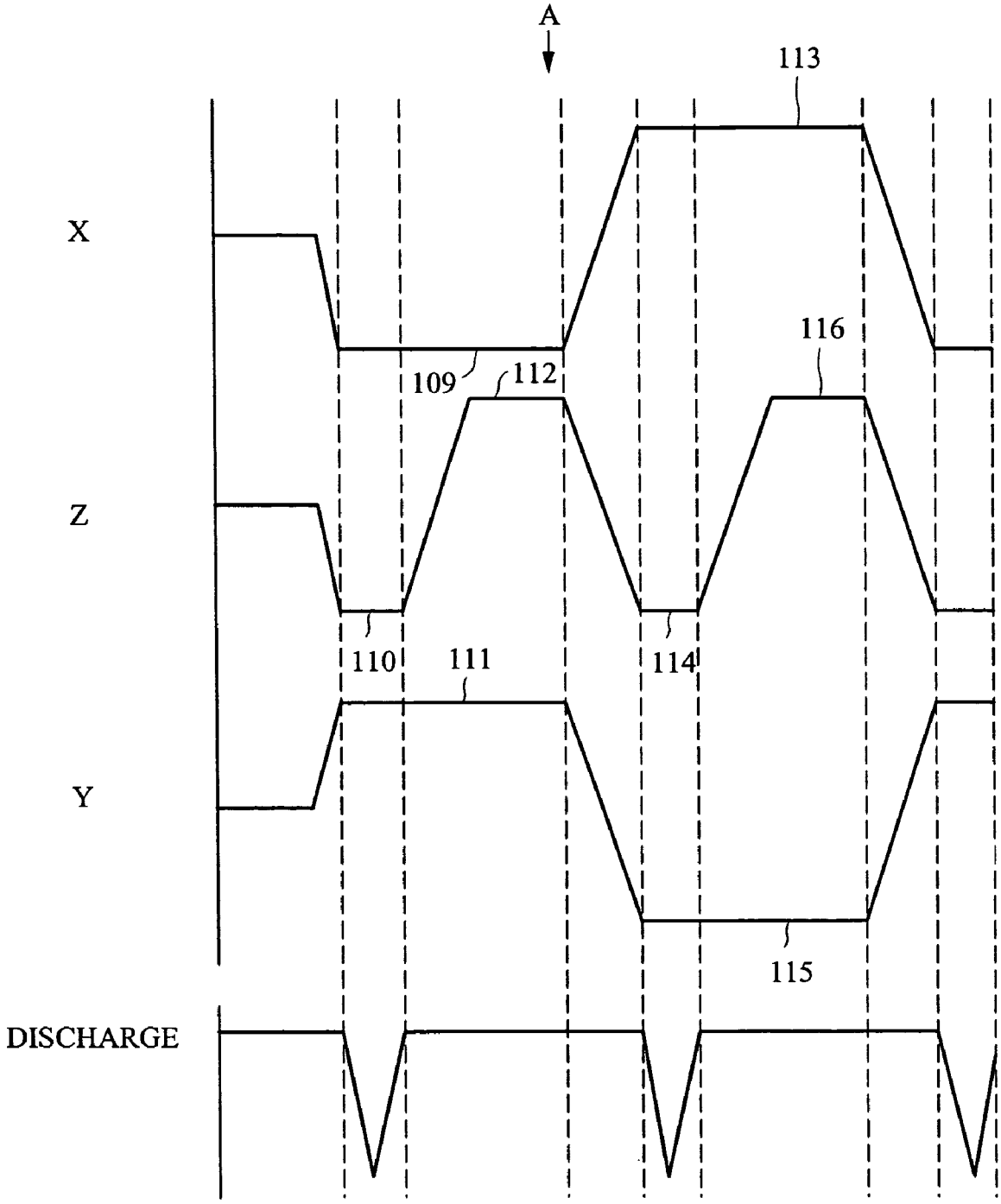
FIG. 7 is a diagram showing details of the driving waveforms in a sustain discharge period of the first embodiment.
Figure 8:
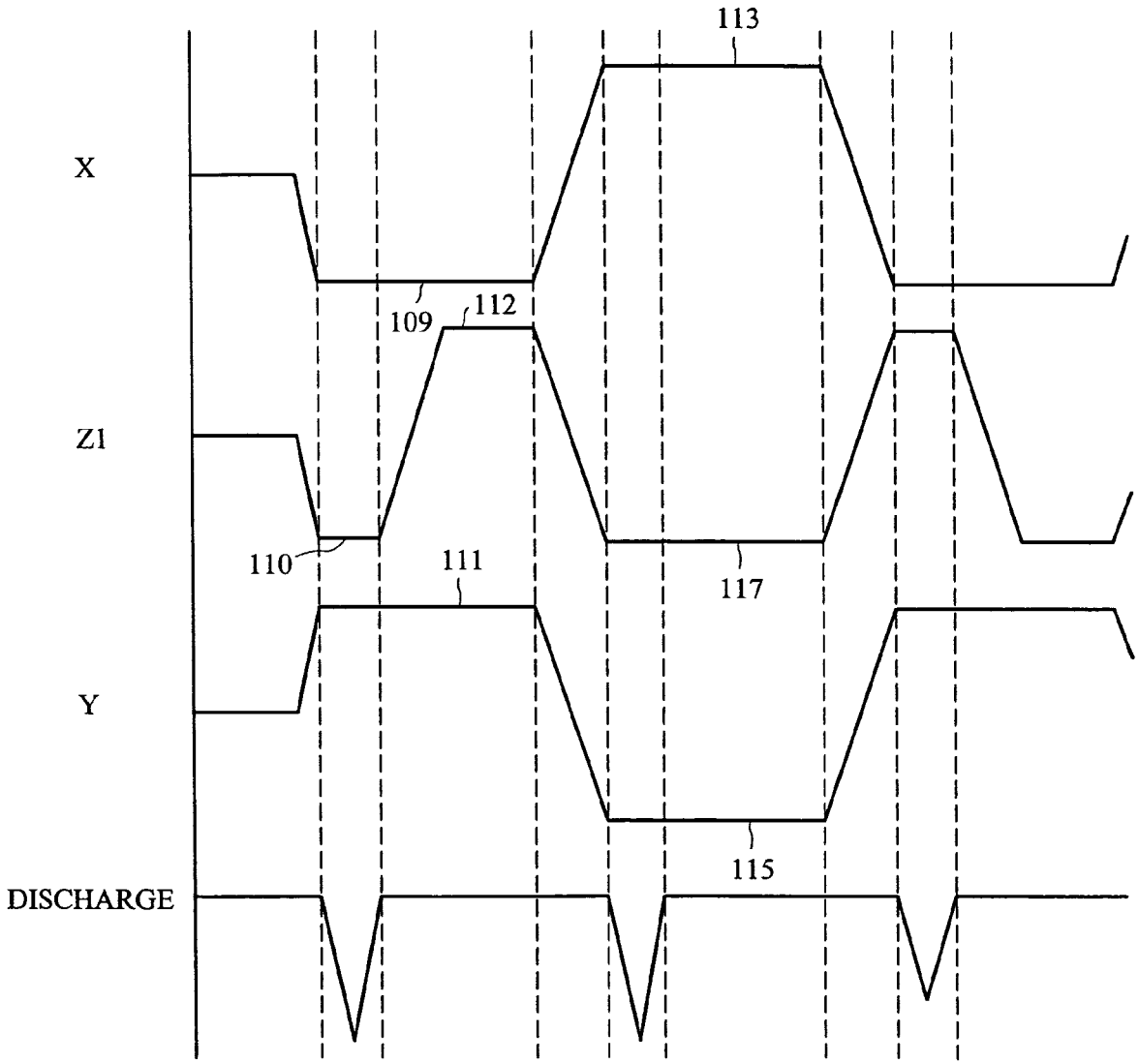
FIG. 8 is a diagram showing details of the driving waveforms in a sustain discharge period of the first embodiment.
Figure 9:
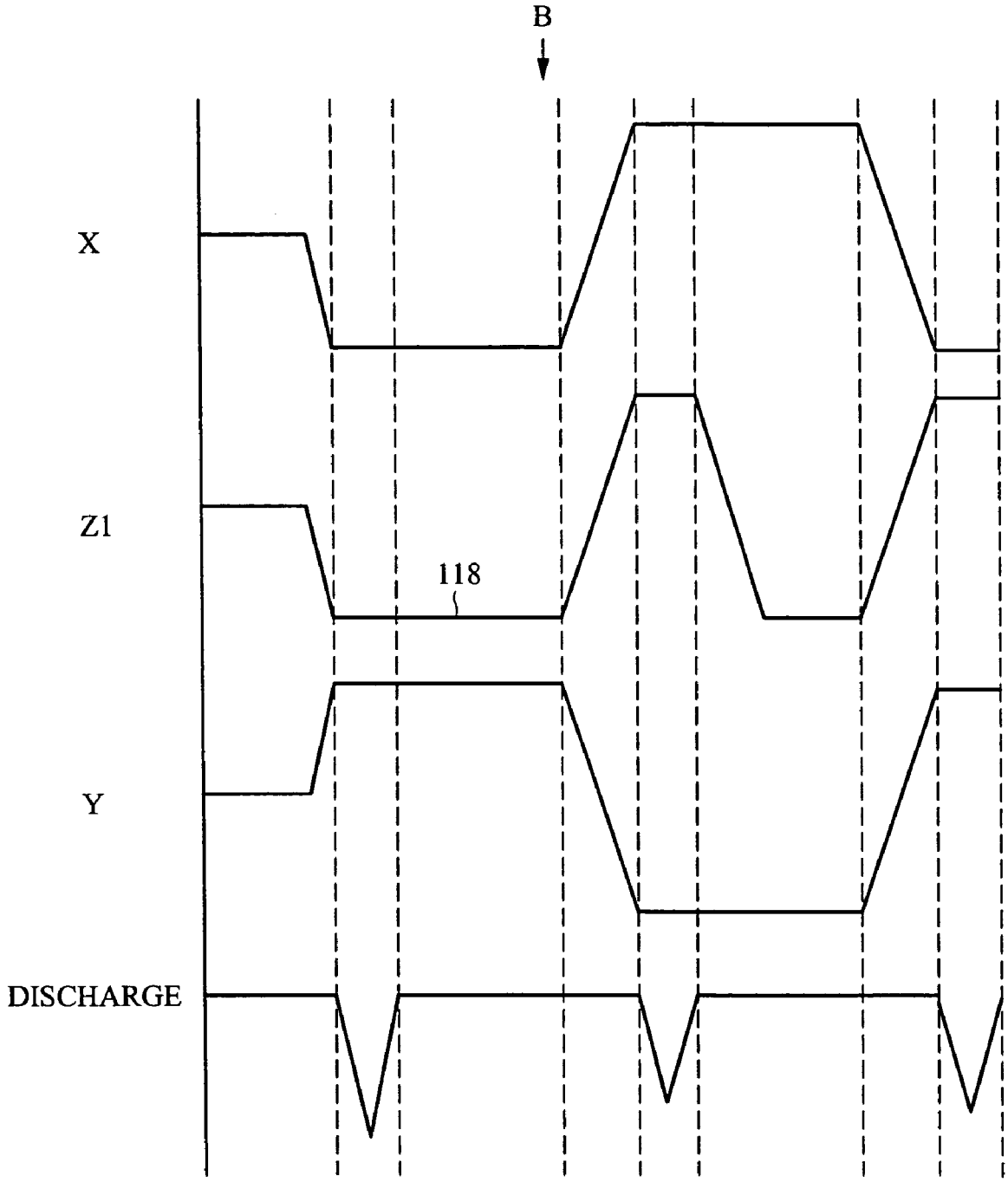
FIG. 9 is a diagram showing details of the driving waveforms in the sustain discharge period of the first embodiment.

FIG. 6 is a diagram showing driving waveforms of one sub-field of the PDP device of the first embodiment, which shows the driving waveforms in the case where the Z electrode operates as a cathode all the time in the sustain discharge period as shown in FIG. 5A. FIG. 7 is a diagram showing details of the driving waveforms in the sustain discharge period of this case. Also, FIG. 8 and FIG. 9 are diagrams showing details of the driving waveforms in the sustain discharge periods of the cases where the Z electrode is controlled to operate as a cathode at first and to operate as an anode from the middle of the period in the sustain discharge period as shown in FIG. 5B, wherein FIG. 8 shows the case where the Z electrode operates as an anode from the third sustain discharge, and FIG. 9 shows the case where the Z electrode operates as an anode from the second sustain discharge.

At the beginning of a reset period, in a state where 0 V is applied to address electrodes A, negative reset pulses 101 and 102 in which a potential is gradually lowered to reach a constant value are applied to the X electrodes and the Z electrodes, and a positive reset pulse 103 in which a predetermined potential is applied and then the potential gradually increases is applied to the Y electrodes. By doing so, in all the cells, discharges are generated between the Z discharge electrodes 16 and the Y discharge electrodes 14 at first, and the discharge is shifted to the discharges between the X discharge electrodes 12 and the Y discharge electrodes 14. Since the pulses applied here are obtuse waves in which the potentials are gradually changed, slight discharges and charge formation are repeated, and wall charge is formed uniformly in all of the cells. The polarity of the formed wall charge is the positive polarity in the vicinities of the X discharge electrodes and the Z discharge electrodes and is the negative polarity in the vicinity of the Y discharge electrodes.

Then, positive compensation potentials 104 and 105 (for example, +Vs) are applied to the X discharge electrodes and the Z discharge electrodes, and a compensation obtuse wave 106 in which the potential gradually decreases is applied to the Y electrodes. By doing so, since the voltage of the polarity opposite to that of the wall charge which has been formed in the above-described manner is applied in the obtuse wave, wall charge in the cells are reduced through slight discharges. In the above-described manner, the reset period is completed, and all of the cells are brought into a uniform state.

In the PDP of the present embodiment, since the distance between the Z discharge electrode 16 and the Y discharge electrode 14 is narrow, a discharge is caused even by a low firing voltage, which triggers a shift to the discharge between the X discharge electrode 12 and the Y discharge electrode 14. Therefore, the reset voltage applied between the X and Z electrodes and the Y electrode in the reset period can be reduced. Accordingly, the amount of light emitted through the reset discharges which are not involved in display can be reduced, thereby improving the contrast.

In a subsequent address period, the voltages (for example, +Vs) which is the same as the compensation potentials 104 and 105 are applied to the X electrodes and the Z electrodes, and a predetermined negative potential is applied to the Y electrodes. In this state, a scan pulse 107 is further sequentially applied to the Y electrodes. In accordance with the application of the scan pulse 107, an address pulse 108 is applied to the address electrodes of the cells to be turned on. Consequently, discharges are generated between the Y electrodes to which the scan pulse is applied and the address electrodes to which the address pulse is applied, and these discharges trigger the generation of discharges between the X and Z discharge electrodes and the Y discharge electrodes. Through these address discharges, negative wall charge is formed in the vicinities of the X electrodes and the Z electrodes (on the surface of the dielectric layer), and positive wall charge is formed in the vicinity of the Y electrodes. In this case, the positive wall charge formed in the vicinity of the Y electrode corresponds to the amount of the wall charge of the total negative wall charges formed in the vicinities of the X electrode and the Z electrode. In the cells to which the scan pulse or the address pulse is not applied, the wall charge at the time of the reset is maintained since the address discharge is not generated. In the address period, the scan pulse is sequentially applied to all of the Y electrodes to carry out the above-described operations, and address discharges are generated in all of the cells to be turned on in the entire panel surface.

Note that, at the end of the address period, in the cells in which the address discharges are not generated, a pulse for adjusting the wall charge which has been formed in the reset period is applied in some cases.

In the sustain discharge period, first, a negative sustain discharge pulse 109 of a potential −Vs is applied to the X electrodes, a negative pulse 110 of the potential −Vs is applied to the Z electrodes, and a positive sustain discharge pulse 111 of the potential +Vs is applied to the Y electrodes. In each of the cells in which the address discharge has been carried out, the voltage by the positive wall charge formed in the vicinity of the Y electrode is superimposed on the potential +Vs, and the voltage by the negative wall charge formed in the vicinities of the X electrode and the Z electrode is superimposed on the potential −Vs. Consequently, the voltage between the X and Z electrodes and the Y electrode exceeds the firing voltage, a discharge is first started between the Z discharge electrode and the Y discharge electrode where the distance therebetween is narrow, and the discharge triggers a shift to a discharge between the X electrode and the Y electrode where the distance therebetween is wide. The discharge between the X electrode and the Y electrode is a long-distance discharge, and is a discharge exhibiting good light emission efficiency.

Figure 10A:
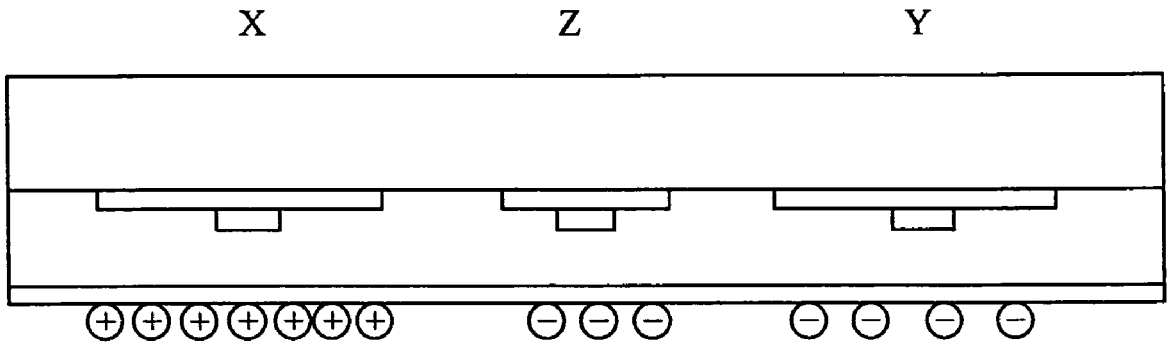
FIG. 10A is a diagram showing the state of wall charge formed in the sustain discharge period of the first embodiment.

As shown in FIG. 7, this discharge is generated when −Vs is applied to the X and Z electrodes and +Vs is applied to the Y electrode (in practice, generated slightly after the application of the potentials), the discharge intensity attains a peak value after a certain time, and then, the discharge intensity is attenuated. In the first embodiment, when the discharge intensity is sufficiently attenuated, a positive pulse 112 of the potential +Vs is applied to the Z electrode. The negative wall charge in the vicinities of the X electrode and the Z electrode and the positive wall charge in the vicinity of the Y electrode have been eliminated in the above-described discharge, and the positive charge and the negative charge generated by the discharge move to the vicinities of the X electrode and the Z electrode and to the vicinity of the Y electrode, respectively. However, sufficient wall charge has not been formed yet. Moreover, although the voltage by the charge in the vicinity of the Z electrode increases the potential of the Z electrode, the voltages by the charge in the vicinities of the X electrode and the Y electrode increase the potential of the X electrode and decrease the potential of the Y electrode. Therefore, even when the pulse 112 is applied, no discharge is generated between the X electrode and the Z electrode and between the Y electrode and the Z electrode. When the potential +Vs is applied to the Z electrode, the positive charge in the vicinity of the Z electrode is not accumulated on the dielectric layer immediately above the Z electrode, but inversely, negative charge moves onto the dielectric layer immediately above the Z electrode so as to form negative wall charge. FIG. 10A shows the state of the wall charge in the cell at this point (point denoted as A in FIG. 7). Positive wall charge is formed on the dielectric layer immediately above the X electrode, negative wall charge is formed on the dielectric layer immediately above the Y electrode, and negative wall charge is formed also on the dielectric layer immediately above the Z electrode.

The timing for applying the positive pulse 112 of the potential +Vs to the Z electrode is determined in the manner described below. Ultraviolet rays are generated by the discharge, the ultraviolet rays excite the phosphor to emit visible light, and the light is outputted to outside the panel through the glass substrate. The ultraviolet rays are not outputted to outside since they are absorbed into the glass substrate, and the ultraviolet rays cannot be detected outside the panel. Infrared light is also generated together with the ultraviolet rays by the discharge, and the generation timing of the ultraviolet rays and the infrared light is approximately the same. Therefore, the state variation of the discharge can be detected by measuring the infrared light. The intensity of the discharge of FIG. 7 is obtained by measuring the infrared light. In this case, the application of the pulse 112 is started at the point when the intensity of the infrared light exceeds the maximum intensity and is reduced to 10% of the peak value.

As described above, the negative wall charge is formed in the vicinities of the Y electrode and the Z electrode, and the positive wall charge is formed in the vicinity of the X electrode. Then, a pulse 113 of the potential +Vs is applied to the X electrode, a pulse 115 of the potential −Vs is applied to the Y electrode, and a pulse 114 of the potential −Vs is applied to the Z electrode. As a result, the voltage between the X electrode and the Y and Z electrodes is superimposed on the voltage by the wall charge, and exceeds the firing voltage. Consequently, first, a discharge is started between the Z discharge electrode and the X discharge electrode where the distance therebetween is narrow, and this discharge triggers a shift to a discharge between the X electrode and the Y electrode where the distance therebetween is wide. This discharge is a discharge in which the Z electrode operates as a cathode. Then, when the discharge intensity is sufficiently attenuated, a positive pulse 116 of the potential +Vs is applied to the Z electrode. Consequently, negative wall charge is formed in the vicinities of the X electrode and the Z electrode, and positive wall charge is formed in the vicinity of the Y electrode. After this, similarly, the sustain discharge pulses of alternately changed polarities are applied to the X electrode and the Y electrode, and the pulse of frequency that is twice the sustain discharge pulse is applied to the Z electrode. By doing so, the sustain discharges in which the Z electrode is operated as a cathode all the time are repeated.

Next, the case where the Z electrode operates as a cathode at the beginning of the sustain discharge period and the electrode operates as an anode from the middle of the period as shown in FIG. 5B will be described with reference to FIG. 8 and FIG. 9.

As shown in FIG. 8, the operation until the second sustain discharge is the same as that of FIG. 7. In the example of FIG. 7, in order to generate the second sustain discharge, the negative pulse 114 of −Vs is applied to the Z electrode and the positive pulse 116 of +Vs is applied to the Z electrode immediately after the sustain discharge is completed. On the other hand, in the example of FIG. 8, a negative pulse 117 of −Vs is applied to the Z electrode and the potential is retained also after the discharge is completed. Consequently, negative wall charge is accumulated in the vicinity of the X electrode, and positive wall charge is accumulated in the vicinities of the Y electrode and the Z electrode. Then, when a negative potential of −Vs is applied to the X electrode and a positive potential of +Vs is applied to the Y electrode and the Z electrode, the discharge is generated between the Y and Z electrodes and the X electrode. At this time, the Z electrode operates as an anode.

After this discharge, although the negative potential of −Vs and the positive potential of +Vs are continuously applied to the X electrode and the Y electrode, respectively, the negative potential of −Vs is applied to the Z electrode. Consequently, positive wall charge is accumulated in the vicinities of the X electrode and the Z electrode, and negative wall charge is accumulated in the vicinity of the Y electrode. Then, when the positive potential of +Vs is applied to the X electrode and the Z electrode and the negative potential of −Vs is applied to the Y electrode, the discharge is generated between the X and Z electrodes and the Y electrode. At this time, the Z electrode operates as an anode. After this, when the potential applied to the Z electrode is changed at the half cycle of the cycle for changing the potentials applied to the X electrode and the Y electrode, the sustain discharges in which the Z electrode operates as an anode are repeated.

Figure 10B:
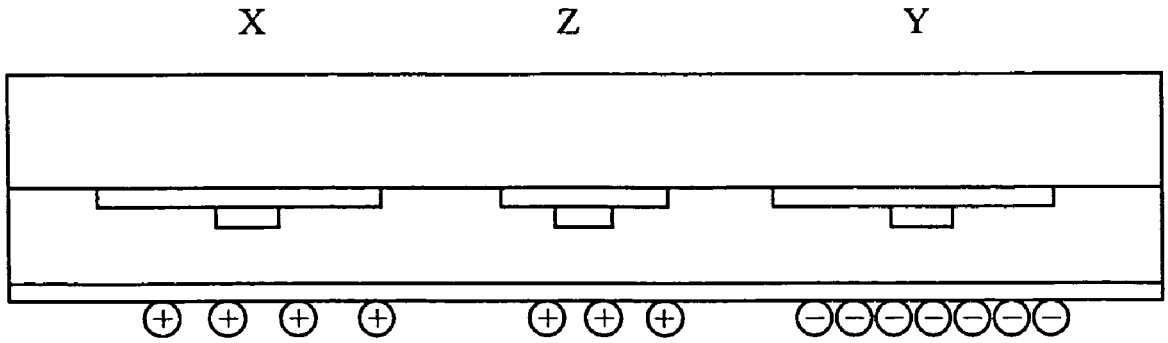
FIG. 10B is a diagram showing the state of wall charge formed in the sustain discharge period of the first embodiment.

In the example of FIG. 9, the operation of the first sustain discharge is the same as that of FIG. 7. In the example of FIG. 7, the positive pulse 112 of +Vs is applied to the Z electrode immediately after the first sustain discharge is completed. On the other hand, in the example of FIG. 9, a negative pulse 118 of −Vs is applied to the Z electrode, and the potential is retained also after the discharge is completed. Consequently, negative wall charge is accumulated in the vicinity of the X electrode, and positive wall charge is accumulated in the vicinities of the Y electrode and the Z electrode. FIG. 10B shows the state at this point (point denoted as B in FIG. 9). Then, when the positive potential of +Vs is applied to the X electrode and the Z electrode and the negative potential of −Vs is applied to the Y electrode, the discharge is generated between the X and Z electrodes and the Y electrode. At this time, the Z electrode operates as an anode.

After this discharge, although the positive potential of +Vs and the negative potential of −Vs are continuously applied to the X electrode and the Y electrode, respectively, the negative potential of −Vs is applied to the Z electrode. Consequently, positive wall charge is accumulated in the vicinities of the Y electrode and the Z electrode, and negative wall charge is accumulated in the vicinity of the X electrode. Then, when the positive potential of +Vs is applied to the Y electrode and the Z electrode, and the negative potential of −Vs is applied to the X electrode, the discharge is generated between the Y and Z electrodes and the X electrode. At this time, the Z electrode operates as an anode. After this, when the potential applied to the Z electrode is changed at the half cycle of the cycle for changing the potentials applied to the X electrode and the Y electrode, the sustain discharges in which the Z electrode operates as an anode are repeated.

A shown in FIG. 7 to FIG. 9, when the potential of the Z electrode is to be changed in order to generate a discharge, it is desired to reduce the load capacitance by changing the potential of the Z electrode at the same time as the potential change of the X electrode and/or the Y electrode.

In the first embodiment, in the reset period and the address period, the same potential is applied to the X electrode and the Z electrode. It is also possible to apply the same potential as that of the Y electrode to the Z electrode in the reset period and the address period. However, since the Y electrode also serves as a scanning electrode, a scan driver for driving the Z electrode is needed to set the Z electrode to the same potential as the Y electrode during a scanning period, which causes a problem of cost increase. Therefore, during the scanning period, the Z electrode is desired to be set to the same potential as the X electrode, and the Z electrode also operates as a cathode as well as the X electrode at the beginning of the sustain discharge period due to the wall charge accumulated by the address discharge.

The first embodiment of the present invention has been described above. However, various modification examples can be provided for the structures and the shapes of the electrodes. Hereinafter, modification examples will be described.

Figure 11:
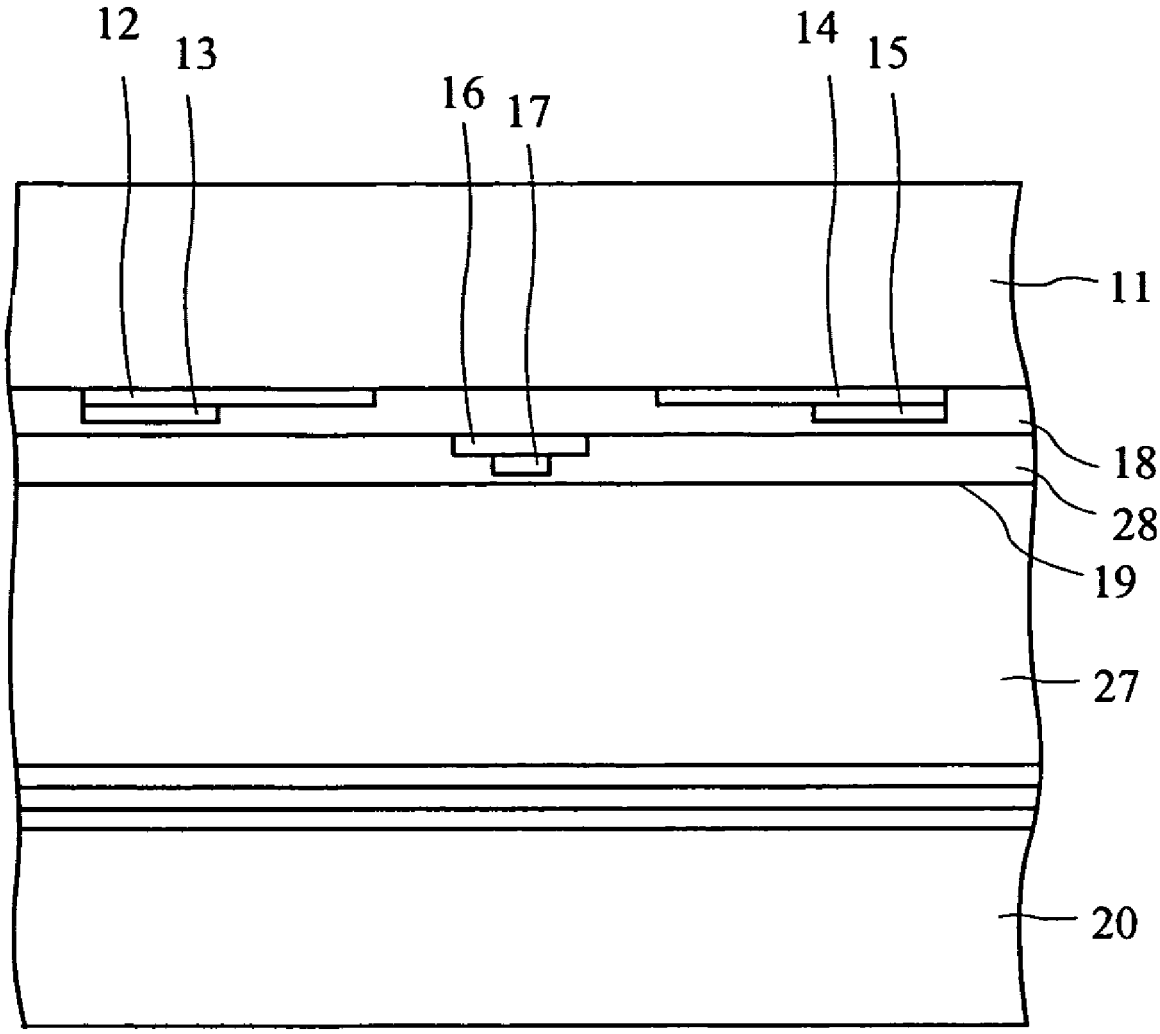
FIG. 11 is a diagram showing a modification example of the electrode structure.

FIG. 11 is a diagram showing a modification example of the electrode structures. In the first embodiment, as shown in FIG. 3A, the Z electrode (Z discharge electrode 16 and Z bus electrode 17) is formed in the same layer as the X electrode (X discharge electrode 12 and X bus electrode 13) and the Y electrode (Y discharge electrode 14 and Y bus electrode 15). In such a case, the Z electrode can be formed in the same process as the X electrode and the Y electrode, and new processes for providing the Z electrodes are not required to be added. However, since the Z electrode is provided between the X discharge electrode 12 and the Y discharge electrode 14, there is a problem that, due to variations in the positions and line widths in fabrication, the Z electrode is short-circuited with the X discharge electrode 12 and the Y discharge electrode 14 and the yield is lowered. Therefore, in the modification example of FIG. 11, the Z electrode (Z discharge electrode 16 and Z bus electrode 17) is formed on the dielectric layer 18 covering the X electrode (X discharge electrode 12 and X bus electrode 13) and the Y electrode (Y discharge electrode 14 and Y bus electrode 15), and the dielectric layer and the Z electrode are covered with a dielectric layer 28. Also in this structure, the same operation as the first embodiment can be carried out.

Although the modification example of FIG. 11 has a problem that the manufacturing cost is increased in comparison with the first embodiment since the process for providing the Z electrode is added. However, the Z electrode is not short-circuited with the X discharge electrode 12 and the Y discharge electrode 14 since the Z electrode is formed in the layer different from that of the X electrode and the Y electrode, and reduction in yield due to short circuit can be prevented. Moreover, since they are provided in different layers, when viewed from above the substrate, the distances between the Z electrode and the X discharge electrode 12 and between the Z electrode and the Y discharge electrode 14 can be significantly reduced, and it is possible to set the distance capable of achieving the approximately Paschen minimum.

Also, as shown in FIG. 4, the X discharge electrode 12 and the Y discharge electrode 14 have a T-shape in each cell, and they are independent from the discharge electrodes of adjacent cells. However, it is also possible to use a conventional electrode shape in which the X and Y discharge electrodes are provided in parallel to the X and Y bus electrodes and electrodes which connect the X and Y bus electrodes to the X and Y discharge electrodes are provided in the part of the barrier ribs.

Second Embodiment

Figure 12:
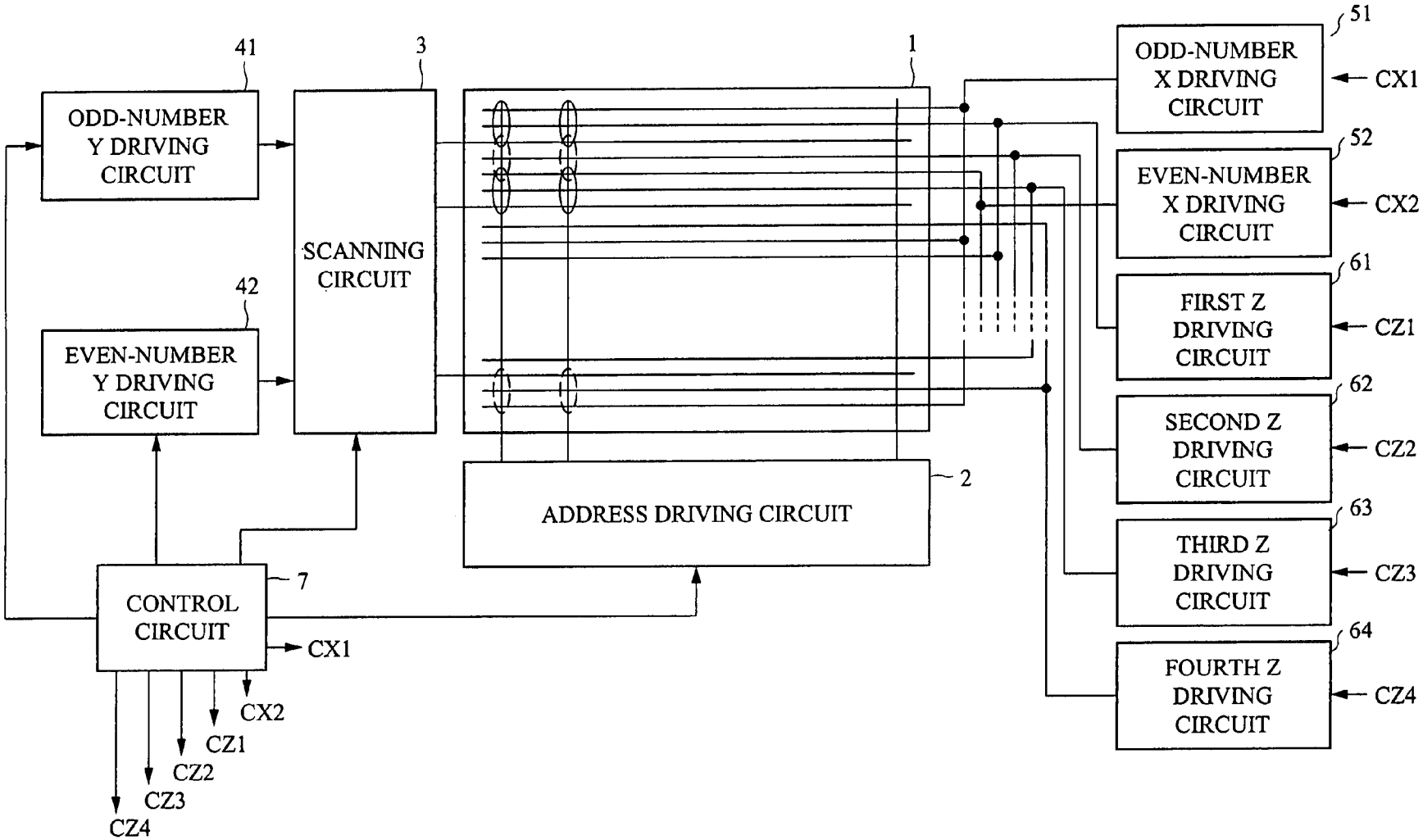
FIG. 12 is a diagram showing the entire structure of a PDP device of a second embodiment of the present invention.

FIG. 12 is a diagram showing the entire structure of a PDP device of the second embodiment of the present invention. The second embodiment is an example in which the present invention is applied to an ALIS PDP device disclosed in Patent Document 5. In this example, in the structure including the first and second electrodes (X and Y electrodes) provided in a first substrate (transparent substrate) and the address electrodes provided in a second electrode (rear substrate), the third (Z electrode) is provided between the X electrode and the Y electrode. Since the ALIS method is disclosed in Patent Document 5, detailed description thereof will be omitted here.

As shown in FIG. 12, the plasma display panel 1 has a plurality of laterally (longitudinally) extending first electrodes (X electrodes) and second electrodes (Y electrodes). The plurality of X electrodes and Y electrodes are alternately disposed, and the number of the lines of the X electrodes is larger than that of the Y electrodes by one. The third electrode (Z electrode) is disposed between the X electrode and the Y electrode. Therefore, the number of the lines of the Z electrodes is twice that of the Y electrodes. The address electrodes are extending in the direction perpendicular to the extending direction of the X, Y, and Z electrodes. In the ALIS method, all of the spaces between the X electrodes and the Y electrodes are utilized as display lines, and odd-number display lines and even-number display lines are subjected to interlaced display. In other words, the odd-number display lines are formed between the odd-numbered X electrodes and the odd-numbered Y electrodes and between the even-numbered X electrodes and even-numbered Y electrodes, and the even-number display lines are formed between the odd-numbered Y electrodes and the even-numbered X electrodes and between the even-numbered Y electrodes and the odd-numbered X electrodes. One display field is comprised of an odd-number field and an even-number field, wherein the odd-number display lines are displayed in the odd-number field, and the even-number display lines are displayed in the even-number field. Therefore, the Z electrodes are present in each of the odd-numbered and even-number display lines. In this case, the Z electrodes provided between the odd-numbered X electrodes and the odd-numbered Y electrodes are referred to as the Z electrodes of a first group, the Z electrodes provided between the odd-numbered Y electrodes and the even-numbered X electrodes are referred to as the Z electrodes of a second group, the Z electrodes provided between the even-numbered X electrodes and the even-numbered Y electrodes are referred to as the Z electrodes of a third group, and the Z electrodes provided between the even-numbered Y electrodes and the odd-numbered X electrodes are referred to as the Z electrodes of a fourth group. In other words, the 4p+1th (wherein p is a natural number) Z electrode is the Z electrode of the first group, the 4p+2th Z electrode is the Z electrode of the second group, the 4p+3th Z electrode is the Z electrode of the third group, and the 4p+4th Z electrode is the Z electrode of the fourth group.

As shown in FIG. 12, the PDP device of the second embodiment has the address driving circuit 2 which drives the address electrodes, the scanning circuit 3 which applies scan pulses to the Y electrodes, an odd-number Y driving circuit 41 which applies voltages other than the scan pulse to the odd-numbered Y electrodes in common via the scanning circuit 3, an even-number Y driving circuit 42 which applies voltages other than the scan pulse to the even-numbered Y electrodes in common via the scanning circuit 3, an odd-number X driving circuit 51 which applies voltages to the odd-numbered X electrodes in common, an even-number X driving circuit 52 which applies voltages to the even-numbered X electrodes in common, a first Z driving circuit 61 which drives the Z electrodes of the first group in common, a second Z driving circuit 62 which drives the Z electrodes of the second group in common, a third Z driving circuit 63 which drives the Z electrodes of the third group in common, a fourth Z driving circuit 64 which drives the Z electrodes of the fourth group in common, and the control circuit 7 which controls each of the circuits.

The PDP of the second embodiment has the same structure as the first embodiment except that the X discharge electrodes and the Y discharge electrodes are provided on both sides of the X bus electrodes and the Y bus electrodes, respectively, and the Z electrodes are provided between all of the X bus electrodes and the Y bus electrodes. Therefore, the exploded perspective view thereof will be omitted. Note that the Z electrodes can be formed in the same layer as the X and Y electrodes as shown in FIG. 3 or can be formed in the layer different from that of the X and Y electrodes as shown in FIG. 11.

Figure 13:
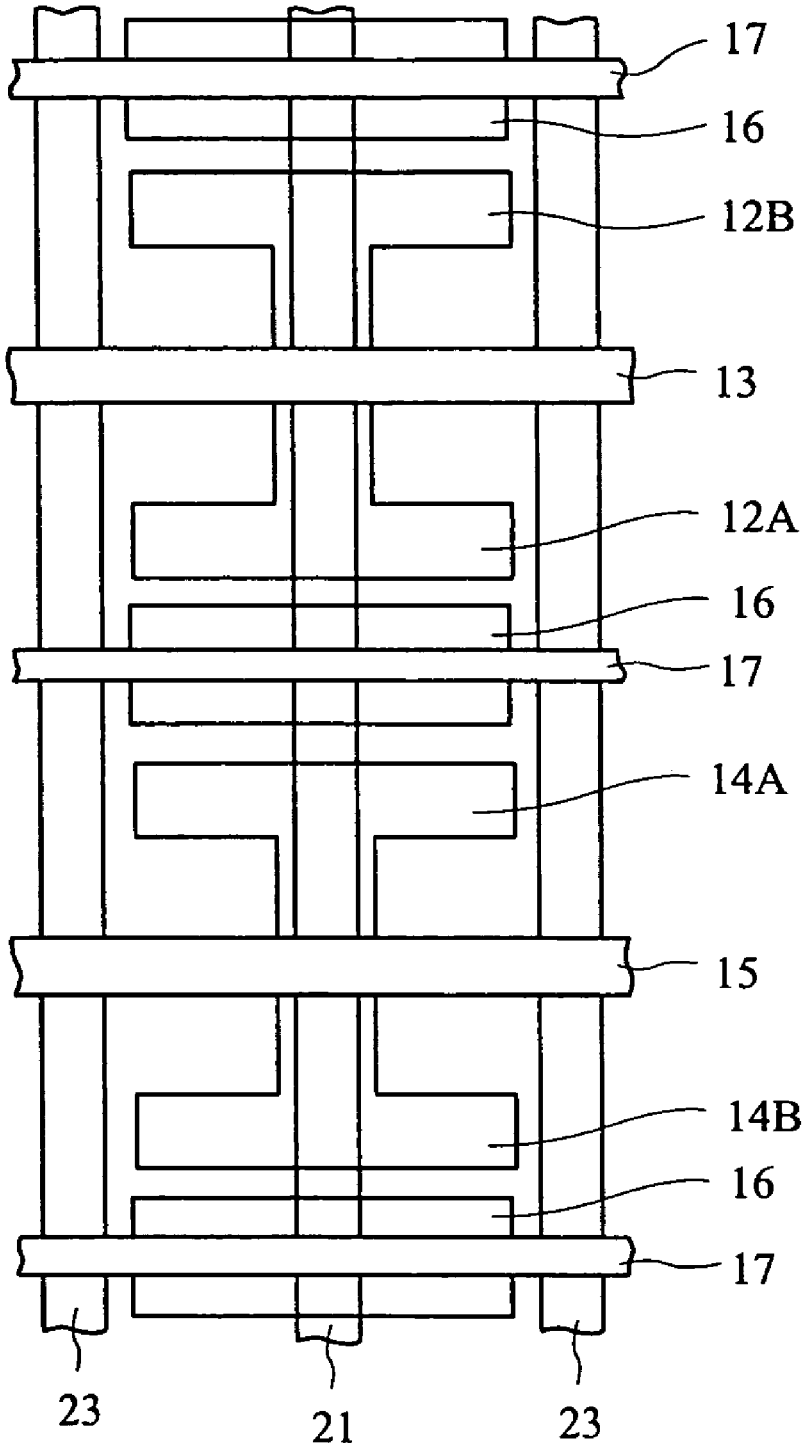
FIG. 13 is a diagram showing the shapes of the electrodes of the second embodiment.

FIG. 13 is a diagram showing the electrode shapes of the second embodiment. As shown in the diagram, the equally-spaced X bus electrode 13 and the Y bus electrode 15 are disposed in parallel to each other, and the Z electrode 16, 17 is disposed in parallel to them at the center between them. In addition, the barrier ribs 23 extending in the direction perpendicular to the bus electrodes 13, 15, and 17 are disposed. The address electrode 21 is disposed between the barrier ribs 23. In each section divided by the barrier ribs 23, an X discharge electrode 12A which is downwardly extending from the X bus electrode 13, an X discharge electrode 12B which is upwardly extending from the X bus electrode 13, a Y discharge electrode 14A which is upwardly extending from the Y bus electrode 15, a Y discharge electrode 14B which is downwardly extending from the Y bus electrode 15, and a Z discharge electrode 16 which is upwardly and downwardly extending from the Z bus electrode 17 are provided. The opposing edges of the X discharge electrodes 12A and 12B and the Z discharge electrode 16 and the opposing edges of the Y discharge electrodes 14A and 14B and the Z discharge electrode 16 are parallel to the extending direction of the X bus electrodes 13, the Y bus electrode 15, and the Z bus electrode 17.

Figure 14:
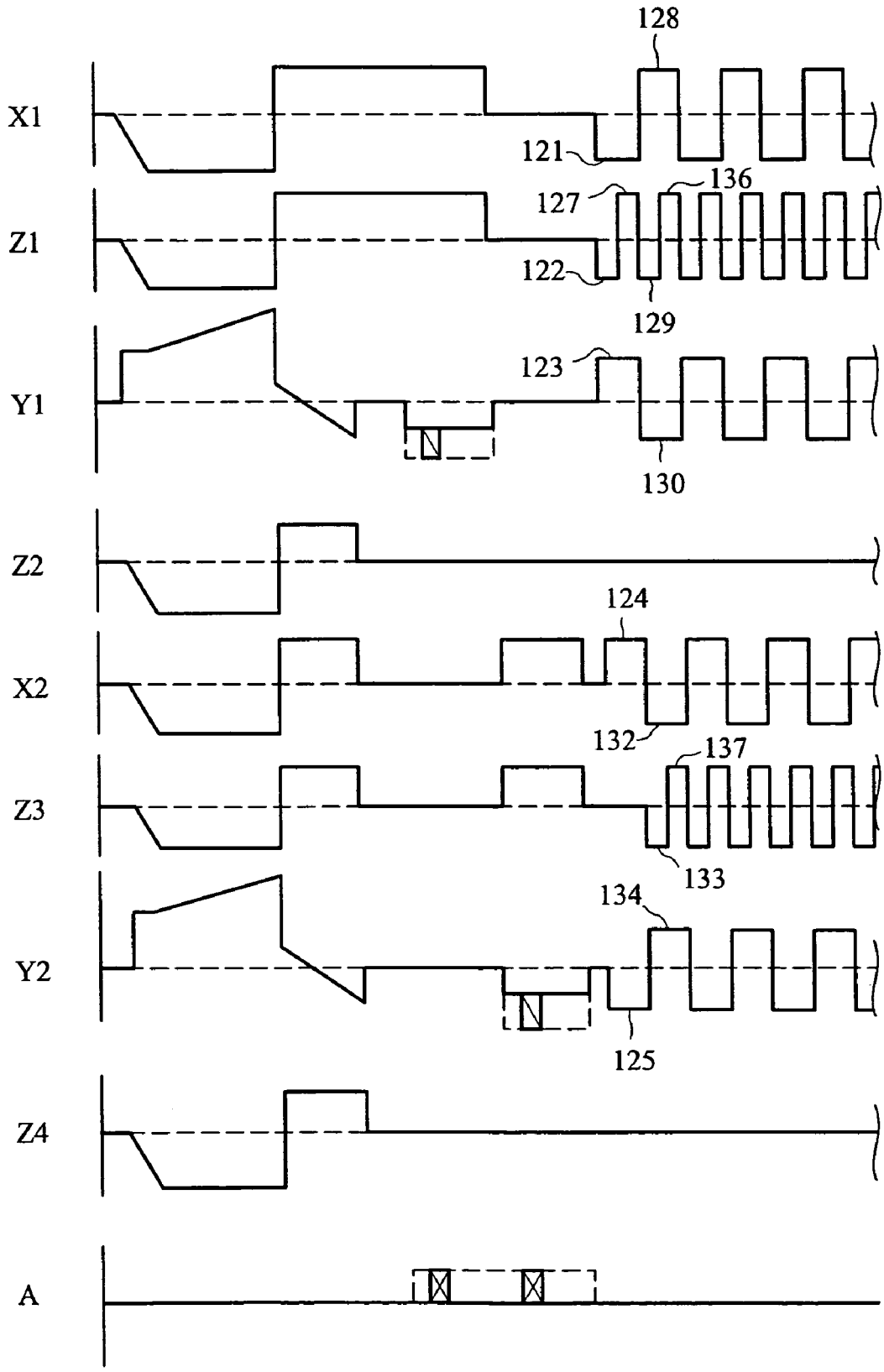
FIG. 14 is a diagram showing driving waveforms (odd-number field) of the second embodiment.
Figure 15:
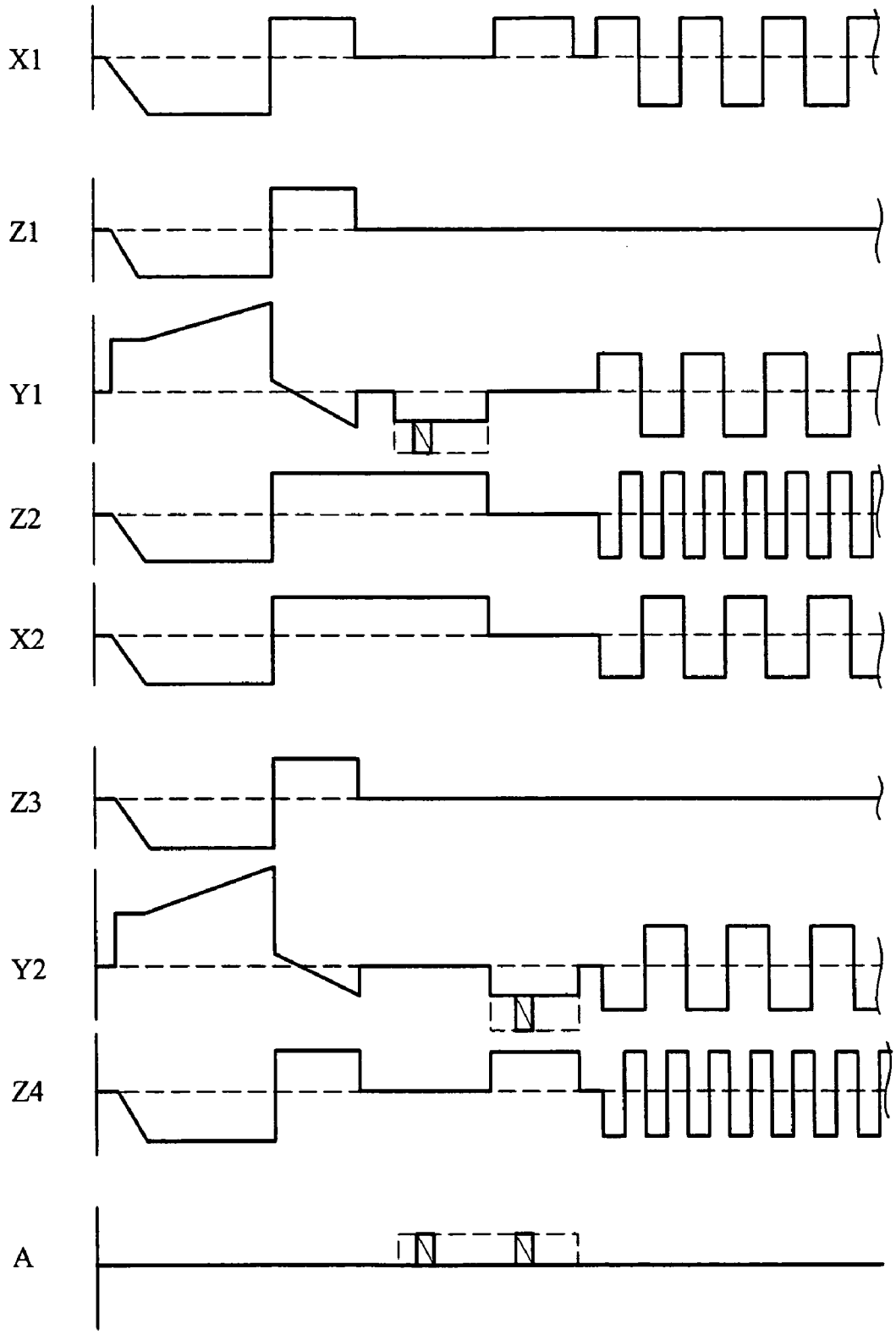
FIG. 15 is a diagram showing driving waveforms (even-number field) of the second embodiment.

FIG. 14 and FIG. 15 are diagrams showing driving waveforms of the PDP device of the second embodiment, wherein FIG. 14 shows the driving waveforms of the odd-number field and FIG. 15 shows the driving waveforms of the even-number field. FIG. 14 and FIG. 15 show the driving waveforms of the case where the Z electrode operates as a cathode all the time in the sustain discharge period like in the first embodiment shown in FIG. 5. If the Z electrode is controlled to operate as a cathode at the beginning and to operate as an anode from the middle of the period in the sustain discharge period, the driving waveforms of, for example, FIG. 8 and FIG. 9 are applied. The driving waveforms applied to the X electrodes, the Y electrodes, and the address electrodes are the same as those disclosed in Patent Document 5, driving waveforms similar to the waveforms shown in FIG. 6 to FIG. 9 are applied to the Z electrode which is provided between the X electrode and the Y electrode where a discharge is to be performed, and an intermediate potential between +Vs and −Vs (in this case, 0 V) is applied to the Z electrode which is provided between the X electrode and the Y electrode where no discharge is to be performed.

The driving waveforms in the reset period are the same as the driving waveforms of the first embodiment, and all of the cells are brought into a uniform state in the reset period.

In the first half of the address period, a predetermined potential (for example, +Vs) is applied to the odd-numbered X electrode X1 and the Z electrode Z1 of the first group, the even-numbered X electrode X2, the even numbered Y electrode Y2, and the Z electrodes Z2 to Z4 of the second to fourth groups are set to be at 0 V, and a predetermined negative potential is applied to the odd-numbered Y electrode Y1. In this state, a scan pulse is further applied sequentially. In accordance with the application of the scan pulse, the address pulse is applied to the address electrode of the cell to be turned on. Consequently, a discharge is generated between the odd-numbered Y electrode Y1 to which the scan pulse has been applied and the address electrode to which the address pulse has been applied, and this discharge triggers the generation of a discharge between the odd-numbered X electrode X1 and the odd-numbered Y electrode Y1 and between the Z electrode Z1 of the first group and the odd-numbered Y electrode Y1. Through this address discharge, negative wall charge is formed in the vicinities of the odd-numbered X electrode X1 and the Z electrode Z1 of the first group (on the surface of the dielectric layer), and positive wall charge is formed in the vicinity of the odd-numbered Y electrode Y1. In the cell to which the address pulse corresponding to the scan pulse is not applied, the wall charge at the time of the reset is maintained since the address discharge is not generated. In the first half of the address period, the scan pulse is applied sequentially to all of the odd-numbered Y electrodes Y1 so as to perform the above-described operations.

In the latter half of the address period, the predetermined potential is applied to the even-numbered X electrode X2 and the Z electrode Z3 of the third group, the odd-numbered X electrode X1, the odd-numbered Y electrode Y1, and the Z electrodes Z1, Z2, and Z4 of the first, second and fourth groups are set to be at 0 V, and the predetermined negative potential is applied to the even-numbered Y electrode Y1. In this state, a scan pulse is further applied sequentially. In accordance with the application of the scan pulse, the address pulse is applied to the address electrode of the cell which is to be turned on. Consequently, a discharge is generated between the even-numbered Y electrode Y2 to which the scan pulse has been applied and the address electrode to which the address pulse has been applied, and this discharge triggers the generation of a discharge between the even-numbered X electrode X2 and the even-numbered Y electrode Y2 and between the Z electrode Z3 of the third group and the even-numbered Y electrode Y2. Through this address discharge, negative wall charge is formed in the vicinities of the even-numbered X electrode X2 and the Z electrode Z3 of the third group, and positive wall charge is formed in the vicinity of the even-numbered Y electrode Y2. In the latter half of the address period, the scan pulse is applied sequentially to all of the even-numbered Y electrodes Y2 so as to perform the above-described operations.

The address operations between the odd-numbered X electrodes X1 and the odd-numbered Y electrodes Y1 and between the even-numbered X electrodes X2 and the even-numbered Y electrodes Y2, i.e., the address operations on the odd-number display lines are completed in the above-described manner. In the cells in which the address discharge has been performed, positive wall charge is formed in the vicinities of the odd-numbered and even-numbered Y electrodes Y1 and Y2, and negative wall charge is formed in the vicinities of the odd-numbered and even-numbered X electrodes X1 and X2 and the Z electrodes Z1 and Z3 of the first and third groups.

In the sustain discharge period, first, negative sustain discharge pulses 121 and 125 of the potential −Vs are applied to the odd-numbered X electrode X1 and the even-numbered Y electrode Y2, positive sustain discharge pulses 123 and 124 of the potential +Vs are applied to the odd-numbered Y electrode Y1 and the even-numbered X electrode X2, a negative pulse 122 of the potential −Vs is applied to the Z electrode Z1 of the first group, and 0 V is applied to the Z electrodes Z2 to Z4 of the second to fourth groups. In the odd-numbered X electrode X1 and the Z electrode Z1 of the first group, the voltages by the negative wall charge are superimposed on the potential −Vs, and the voltage by the positive wall charge is superimposed on the potential +Vs in the odd-numbered Y electrode Y1. As a result, a large voltage is applied therebetween. Consequently, first, a discharge is started between the Z electrode Z1 of the first group and the odd-numbered Y electrode Y1 in which the distance therebetween is narrow, and this discharge triggers a shift to a discharge between the odd-numbered X electrode X1 and the odd-numbered Y electrode Y1 in which the distance therebetween is wide. When this discharge is completed, a positive pulse 127 of the potential +Vs is applied to the Z electrode Z1 of the first group. At this point, positive wall charge is formed in the vicinity of the odd-numbered X electrode X1, and negative wall charge is formed in the vicinities of the odd-numbered Y electrode Y1 and the Z electrode Z1 of the first group.

At this point, in the even-numbered X electrode X2, the Z electrode Z3 of the third group, and the even-numbered Y electrode Y2, no discharge is generated since the accumulated wall charge has opposite polarities, and the wall charge is retained. Note that, instead of applying the pulses 124 and 125, 0 V may be applied to X2 and Y2.

Moreover, since +Vs is applied to the odd-numbered Y electrode Y1 and the even-numbered X electrode X2 and −Vs is applied to the even-numbered Y electrode Y2 and the odd-numbered X electrode X1, no discharge is generated therebetween. The potential +Vs is applied to the odd-numbered Y electrode Y1, and 0 V is applied to the Z electrode Z2 of the second group. Therefore, the voltage by the positive wall charge is superimposed in the odd-numbered Y electrode Y1, and the voltage between the odd-numbered Y electrode Y1 and the Z electrode Z2 of the second group increases. However, since the voltage applied to the Z electrode Z2 of the second group is 0 V and no wall charge has been formed in the Z electrode Z2 of the second group, the voltage by wall charge is not superimposed, and no discharge is generated. Conversely, the voltage applied to the Z electrode Z2 of the second group has to be set to the voltage that does not cause a discharge. However, the voltage applied to the Z electrode Z2 of the second group is desired to be lower than the voltage +Vs applied to the adjacent odd-numbered Y electrode Y1 and even-numbered X electrode X2. This is for the following reason. When a sustain discharge is generated between the odd-numbered X electrode X1 and the odd-numbered Y electrode Y1, mobile electrons move from the odd-numbered X electrode X1 to the odd-numbered Y electrode Y1. However, if the voltage of the Z electrode Z2 of the second group is the same as the voltage of the odd-numbered Y electrode Y1, the electrons directly move to the Z electrode Z2 of the second group, and then reach the even-numbered X electrode X2. In such a case, when the sustain discharge pulse of the opposite polarity is then applied, an erroneous discharge is generated, and a display error occurs. On the other hand, when the voltage of the Z electrode Z2 of the second group is set to be lower than the voltage of the odd-numbered Y electrode Y1 like the present embodiment, the movement of the electrons can be prevented, and the occurrence of erroneous discharges between adjacent display lines can be prevented.

Then, positive sustain discharge pulses 128 and 134 of the potential +Vs are applied to the odd-numbered X electrode X1 and the even-numbered Y electrode Y2, negative sustain discharge pulses 130 and 132 of the potential −Vs are applied to the odd-numbered Y electrode Y1 and the even-numbered X electrode X2, negative pulses 129 and 133 of the potential −Vs are applied to the Z electrodes Z1 and Z3 of the first and third groups, and 0 V is applied to the Z electrode Z2 of the second group and the Z electrode Z4 of the fourth group. In the odd-numbered X electrode X1 and the Z electrode Z1 of the first group, as described above, positive wall charge has been formed through the previous sustain discharge, and the resulting voltage is superimposed on the potential +Vs, and in the odd-numbered Y electrode Y1, the voltage by the negative wall charge accumulated thorough the previous sustain discharge is superimposed on the potential −Vs. As a result, a large voltage is applied therebetween. Furthermore, in the even-numbered X electrode X2 and the Z electrode Z3 of the third group, the negative wall charge at the time when the addressing is completed has been retained, the resulting voltage is superimposed on the potential −Vs, and in the even-numbered Y electrode Y2, the positive wall charge at the time when addressing is completed has been retained, and the resulting voltage is superimposed on the potential +Vs. As a result, a large voltage is applied therebetween. Consequently, discharges are started between the Z electrode Z1 of the first group and the odd-numbered Y electrode Y1 and between the Z electrode Z3 of the third group and the even-numbered Y electrode Y2 in which the distances therebetween are narrow, and these discharges trigger the shifts to discharges between the odd-numbered X electrode X1 and the odd-numbered Y electrode Y1 and between the even-numbered X electrode X2 and the even-numbered Y electrode Y2 in which the distances therebetween are wide. When these discharges are completed, similar to the first embodiment, positive pulses 136 and 137 of the potential +Vs are applied to the Z electrode Z1 and Z3 of the first and third groups. Consequently, positive wall charge is formed in the vicinities of the odd-numbered X electrode X1, the Z electrode Z1 of the first group, the even-numbered X electrode X2, and the Z electrode Z3 of the third group, and negative wall charge is formed in the vicinities of the odd-numbered Y electrode Y1 and the even-numbered Y electrode Y2.

At this point, the same voltage −Vs is applied to the odd-numbered Y electrode Y1 and the even-numbered X electrode X2, and the same voltage +Vs is applied between the even-numbered Y electrode Y2 and the odd-numbered X electrode X1. Therefore, no discharge is generated therebetween. Also, though the voltage Vs is applied between the even-numbered Y electrode Y2 and the Z electrode Z4 of the fourth group, no discharge is generated therebetween as described above, and movement of the electrons generated in the adjacent cells is prevented, and the occurrence of erroneous discharges is prevented.

After that, the sustain discharge pulses are repeatedly applied while inverting the polarities thereof and the pulses are applied to each of the Z electrodes. By doing so, the sustain discharges are repeated.

As described above, the first sustain discharge is generated only between the odd-numbered X electrode X1 and the odd-numbered Y electrode Y1, and it is not generated between the even-numbered X electrode X2 and the even-numbered Y electrode Y2. Therefore, it is controlled so that a sustain discharge is generated only between the even-numbered X electrode X2 and the even-numbered Y electrode Y2, and no discharge is generated between the odd-numbered X electrode X1 and the odd-numbered Y electrode Y1 at the end of the sustain discharge period. By doing so, the numbers of times of the sustain discharges are made equal to each other.

In the foregoing, the driving waveforms of the odd-number field have been described. In the driving waveforms of the even-number field, the same driving waveforms as those in the odd-number field are applied to the odd-numbered and even-numbered Y electrodes Y1 and Y2, the driving waveform applied to the even-numbered X electrode X2 of the odd-number field is applied to the odd-numbered X electrode X1, the driving waveform applied to the odd-numbered X electrode X1 of the odd-number field is applied to the even-numbered X electrode X2, the waveform applied to the Z electrode Z2 of the second group of the odd-number field is applied to the Z electrode Z1 of the first group, the driving waveform applied to the Z electrode Z1 of the first group of the odd-number field is applied to the Z electrode Z2 of the second group, the driving waveform applied to the Z electrode Z4 of the fourth group of the odd-number field is applied to the Z electrode Z3 of the third group, and the driving waveform applied to the Z electrode Z3 of the third group of the odd-number field is applied to the Z electrode Z4 of the fourth group.

Figure 16:
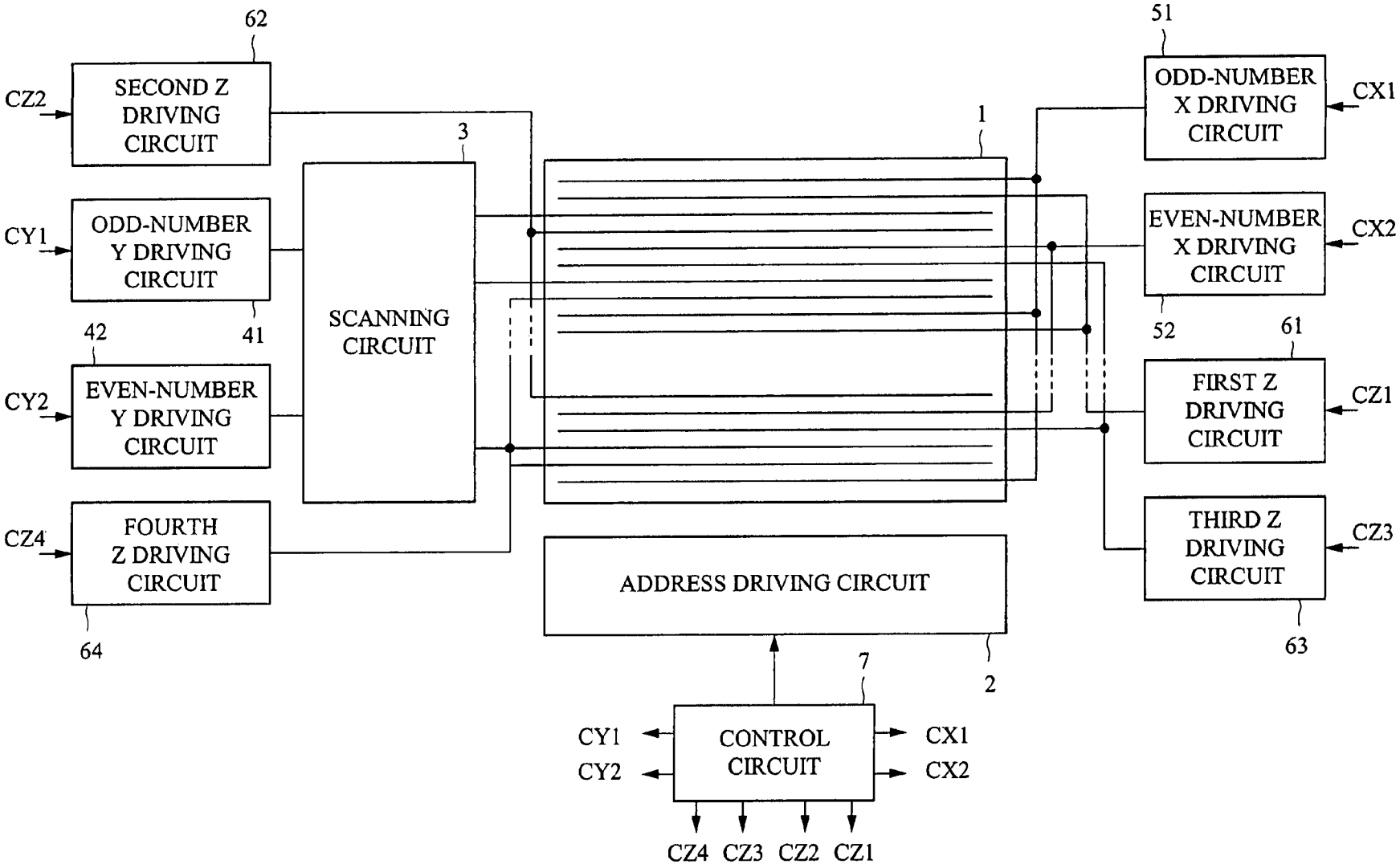
FIG. 16 is a diagram showing the entire structure of the PDP device of a modification example of the second embodiment.

FIG. 16 is a diagram showing the entire structure of a PDP device of a modification example of the second embodiment. This modification example is different from the second embodiment in that the Z electrodes Z1 and Z3 of the first and third groups are led to the right side of the panel 1 and the Z electrodes Z2 and Z4 of the second and fourth groups are led to the left side of the panel 1, in other words, the Z electrodes are alternately led to the left and right sides of the panel.

In the foregoing, the PDP device of the second embodiment has been described. Note that the modification example described in the first embodiment can be applied to the ALIS PDP device of the second embodiment.

(Note 1)

In a driving method of a plasma display panel comprising: a plurality of first, second, and third electrodes which are disposed to be adjacent to each other and extending in a first direction, the third electrodes being provided respectively between the first and second electrodes between which discharges are to be repeated; and a dielectric layer which covers the plurality of first, second, and third electrodes, grayscale display is carried out by means of a sub-field method, and the third electrodes are set to have a potential which is approximately the same as the potential of one of the first and second electrodes at least at the time of the discharges during a period when the discharges are repeated between the first and second electrodes, and a ratio of the discharges in which the third electrodes operate as cathodes to the discharges in which the third electrodes operate as anodes in the period when the discharges are repeated between the first and second electrodes is changed at least in one sub-field. (1)

(Note 2)

In the driving method of a plasma display panel according to Note 1, the ratio of the discharges in which the third electrodes operate as cathodes to the discharges in which the third electrodes operate as anodes at the time of the discharges in the period when the discharges are repeated is changed when sustain pulses in one field are changed. (2)

(Note 3)

In the driving method of a plasma display panel according to Note 2, when the number of the sustain pulses in the one field is at an upper limit value, the third electrodes operate only as cathodes at the time of the discharges in the period when the discharges are repeated. (3)

(Note 4)

In the driving method of a plasma display panel according to any one of Notes 1 to 3, the third electrodes operate as cathodes at the time of the first discharge in the period when the discharges are repeated. (4)

(Note 5)

In the driving method of a plasma display panel according to Note 4, when a state where the third electrodes operate as cathodes is to be switched to a state where the third electrodes operate as anodes in the period when the discharges are repeated, potential of the third electrodes is changed in synchronization with a potential change of the first or second electrodes which are to be subsequently operated as anodes. (5)

(Note 6)

In a plasma display device comprising: a plasma display panel including a plurality of first, second, and third electrodes which are disposed to be adjacent to each other and extending in a first direction, the third electrodes being provided respectively between the first and second electrodes between which discharges are to be repeated, and a dielectric layer which covers the plurality of first, second, and third electrodes; a first electrode driving circuit for driving the plurality of first electrodes; a second electrode driving circuit for driving the plurality of second electrodes; and a third electrode driving circuit for driving the plurality of third electrodes, grayscale display is carried out by means of a sub-field method, and the third electrodes are set to have a potential which is approximately the same as the potential of one of the first and second electrodes at least at the time of the discharges during a period when the discharges are repeated between the first and second electrodes, and the third electrode driving circuit changes a ratio of the discharges in which the third electrodes operate as cathodes to the discharges in which the third electrodes operate as anodes in the period when the discharges are repeated between the first and second electrodes, at least in one sub-field. (6)

(Note 7)

In the plasma display device according to Note 6, when sustain pulses in one field are changed, the third electrode driving circuit changes the ratio of the discharges in which the third electrodes operate as cathodes to the discharges in which the third electrodes operate as anodes at the time of the discharges in the period when the discharges are repeated. (7)

(Note 8)

In the plasma display device according to Note 7, when the number of the sustain pulses in the one field is at an upper limit value, the third electrode driving circuit makes the third electrodes operate only as cathodes at the time of the discharges in the period when the discharges are repeated. (8)

(Note 9)

In the plasma display device according to any one of Notes 6 to 8, the third electrode driving circuit makes the third electrodes operate as cathodes at the time of the first discharge in the period when the discharges are repeated. (9)

(Note 10)

In the plasma display device according to Note 9, when a state where the third electrodes operate as cathodes is to be switched to a state where the third electrodes operate as anodes in the period when the discharges are repeated, the third electrode driving circuit changes potential of the third electrodes in synchronization with a potential change of the first or second electrodes which are to be subsequently operated as anodes. (10)

(Note 11)

In the plasma display device according to Note 6, the plurality of first and second electrodes form pairs, and the third electrode is provided between the first electrode and the second electrode of each pair, and the third electrode driving circuit applies a common potential to the plurality of third electrodes. (11)

(Note 12)

In the plasma display device according to Note 6, the plurality of third electrodes are provided between all of the plurality of first electrodes and the plurality of second electrodes, and an odd-number field in which repetitive discharges for display are performed between the second electrodes and the first electrodes adjacent to one side of the second electrodes and an even-number field in which the repetitive discharges for display are performed between the second electrodes and the first electrodes adjacent to the other side of the second electrodes are provided. (12)

As described above, according to the present invention, a plasma display panel, which can improve the light-emission luminance and grayscale display accuracy of a PDP and can realize a PDP device having good display quality at low cost, can be provided.

What is claimed is:

1. A driving method of a plasma display panel comprising: a plurality of first, second, and third electrodes which are disposed to be adjacent to each other and extending in a first direction, said third electrodes being provided respectively between said first and second electrodes between which discharges are to be repeated; and a dielectric layer which covers said plurality of first, second, and third electrodes, wherein grayscale display is carried out by means of a sub-field method, and said third electrodes are set to have a potential which is approximately the same as the potential of one of said first and second electrodes at least at the time of the discharges during a period when the discharges are repeated between said first and second electrodes, and a ratio of the discharges in which said third electrodes operate as cathodes to the discharges in which said third electrodes operate as anodes in the period when said discharges are repeated between said first and second electrodes is changed at least in one sub-field.

2. The driving method of a plasma display panel according to claim 1, wherein the ratio of the discharges in which said third electrodes operate as cathodes to the discharges in which said third electrodes operate as anodes at the time of the discharges in the period when said discharges are repeated is changed when sustain pulses in one field are changed.

3. The driving method of a plasma display panel according to claim 2, wherein, when the number of the sustain pulses in the one field is at an upper limit value, said third electrodes operate only as cathodes at the time of the discharges in the period when said discharges are repeated.

4. The driving method of a plasma display panel according to claim 1, wherein said third electrodes operate as cathodes at the time of the first discharge in the period when said discharges are repeated.

5. The driving method of a plasma display panel according to claim 4, wherein, when a state where said third electrodes operate as cathodes is to be switched to a state where said third electrodes operate as anodes in the period when said discharges are repeated, potential of said third electrodes is changed in synchronization with a potential change of said first or second electrodes which are to be subsequently operated as anodes.

6. A plasma display device comprising:

a plasma display panel including a plurality of first, second, and third electrodes which are disposed to be adjacent to each other and extending in a first direction, said third electrodes being provided respectively between said first and second electrodes between which discharges are to be repeated, and a dielectric layer which covers said plurality of first, second, and third electrodes;

a first electrode driving circuit for driving said plurality of first electrodes;

a second electrode driving circuit for driving said plurality of second electrodes; and a third electrode driving circuit for driving said plurality of third electrodes, wherein grayscale display is carried out by means of a sub-field method, and said third electrodes are set to have a potential which is approximately the same as the potential of one of said first and second electrodes at least at the time of the discharges during a period when the discharges are repeated between said first and second electrodes, and said third electrode driving circuit changes a ratio of the discharges in which said third electrodes operate as cathodes to the discharges in which said third electrodes operate as anodes in the period when said discharges are repeated between said first and second electrodes, at least in one sub-field.

7. The plasma display device according to claim 6, wherein, when sustain pulses in one field are changed, said third electrode driving circuit changes the ratio of the discharges in which said third electrodes operate as cathodes to the discharges in which said third electrodes operate as anodes at the time of the discharges in the period when said discharges are repeated.

8. The plasma display device according to claim 7, wherein, when the number of the sustain pulses in the one field is at an upper limit value, said third electrode driving circuit makes said third electrodes operate only as cathodes at the time of the discharges in the period when said discharges are repeated.

9. The plasma display device according to claim 6, wherein said third electrode driving circuit makes said third electrodes operate as cathodes at the time of the first discharge in the period when said discharges are repeated.

10. The plasma display device according to claim 9, wherein, when a state where said third electrodes operate as cathodes is to be switched to a state where said third electrodes operate as anodes in the period when said discharges are repeated, said third electrode driving circuit changes potential of said third electrodes in synchronization with a potential change of said first or second electrodes which are to be subsequently operated as anodes.

11. The driving method of a plasma display panel according to claim 2, wherein said third electrodes operate as cathodes at the time of the first discharge in the period when said discharges are repeated.

12. The driving method of a plasma display panel according to claim 3, wherein said third electrodes operate as cathodes at the time of the first discharge in the period when said discharges are repeated.

13. The plasma display device according to claim 7, wherein said third electrode driving circuit makes said third electrodes operate as cathodes at the time of the first discharge in the period when said discharges are repeated.

14. The plasma display device according to claim 8, wherein said third electrode driving circuit makes said third electrodes operate as cathodes at the time of the first discharge in the period when said discharges are repeated.

* * * * *